US008915580B2

(12) United States Patent
Shirotori

(10) Patent No.: US 8,915,580 B2
(45) Date of Patent: Dec. 23, 2014

(54) LIQUID SUPPLYING APPARATUS AND LIQUID EJECTING APPARATUS

(75) Inventor: Motoyoshi Shirotori, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 239 days.

(21) Appl. No.: 13/371,215

(22) Filed: Feb. 10, 2012

(65) Prior Publication Data

US 2012/0206547 A1 Aug. 16, 2012

(30) Foreign Application Priority Data

Feb. 15, 2011 (JP) ..... 2011-029956
Feb. 15, 2011 (JP) ..... 2011-029957

(51) Int. Cl.
*B41J 2/175* (2006.01)
*B41J 2/17* (2006.01)

(52) U.S. Cl.
CPC ..... *B41J 2/175* (2013.01); *B41J 2/17523* (2013.01); *B41J 2/1752* (2013.01); *B41J 2/17596* (2013.01)
USPC ..... 347/85; 347/84; 347/86

(58) Field of Classification Search
USPC ..... 347/84, 85, 86
See application file for complete search history.

(56) References Cited

U.S. PATENT DOCUMENTS 7,992,981 B2 8/2011 Yokouchi
2009/0147053 A1* 6/2009 Yokouchi ..... 347/54
2010/0020126 A1* 1/2010 Takahashi ..... 347/30

FOREIGN PATENT DOCUMENTS

JP 2009-160912 7/2009

* cited by examiner

*Primary Examiner* — Jannelle M Lebron
(74) *Attorney, Agent, or Firm* — Workman Nydegger

(57) ABSTRACT

A liquid supplying apparatus of a printer includes a liquid supplying path for supplying liquid from an upstream side which becomes a liquid accommodator side toward a downstream side which becomes a liquid ejecting head side; a pump; a buffer which is provided at a downstream side of the pump in the liquid supplying path, temporarily stores the liquid discharged from the pump, and has a movable section for supplying the temporarily stored liquid toward the liquid ejecting head side under pressure; and a chalk valve which is provided between the buffer and the liquid ejecting head in the liquid supplying path, and is closed to block the liquid supplying path when a negative pressure of the downstream side which becomes the liquid ejecting head side is greater than a pressing force of an upstream side which becomes the buffer side.

18 Claims, 15 Drawing Sheets

LIQUID SUPPLYING APPARATUS AND LIQUID EJECTING APPARATUS

BACKGROUND

1. Technical Field

The present invention relates to a liquid supplying apparatus for supplying liquid, for example, such as ink, and a liquid ejecting apparatus including the liquid supplying apparatus.

2. Related Art

An ink jet type printer (hereinafter, in some cases, abbreviated as a "printer") is widely known as a liquid ejecting apparatus that ejects liquid to a target such as paper. In the related art, in such a printer, there is a printer which includes a liquid supplying apparatus using a pulsating type pump such as a diaphragm type pump in order to supply a liquid ejecting head that ejects ink (liquid) with ink (for example, JP-A-2009-160912).

In addition, in the pulsating type pump, in order to alternately perform a suction operation of sucking ink from a liquid supply source such as an ink cartridge and a discharging operation of discharging ink sucked by the suction operation toward the liquid ejecting head side, while performing the suction operation, the supplying of ink is temporarily stopped. For that reason, in order to supply ink toward the liquid ejecting head side even while performing the suction operation, the liquid supplying apparatus of JP-A-2009-160912 is provided with a buffer chamber that stores ink discharged from the pump.

However, in order to perform choke cleaning as maintenance of the liquid ejecting head, the printer of JP-A-2009-160912 is provided with a choke valve (a differential pressure valve) for blocking an ink flow path that supplies ink from the pump to the liquid ejecting head. Moreover, in the case of performing the choke cleaning, the choke valve is closed by a negative pressure to be applied from opening sides of nozzles provided in the liquid ejecting head so as to eject ink, thereby blocking the ink flow path.

Herein, in the printer of JP-A-2009-160912, since the choke valve is placed between the pump and the buffer chamber, when the choke valve is closed to block the ink flow path, the inner portion of the buffer chamber also receives the negative pressure. Furthermore, in order to change a storage capacity and pressurize the stored ink, the buffer chamber is provided with a movable section such as a movable wall constituted by a film member or the like having flexibility. For that reason, there is a problem in that the movable section of the buffer chamber is strongly attracted in the direction of reducing the storage capacity at each choke cleaning, and a great load is applied to the movable section.

Furthermore, as shown in FIG. 17, such a printer 110 is provided with a cartridge holder 123 for mounting an ink cartridge 122 to an upper side of a carriage 121 supporting a liquid ejecting head 120. Furthermore, in the case of feeding a sheet of paper P which becomes a target from a rear side of the printer 110, a transport mechanism 125 for transporting the paper P to the rear sides of the carriage 121 and a liquid supplying apparatus 124 is placed. In addition, a pump 126 and a buffer chamber 127 constituting the liquid supplying apparatus 124 are placed so as to be aligned vertically for each color of ink at the rear side of the cartridge holder 123, as shown in FIG. 18.

Moreover, in the printer, a reduction in size of the whole apparatus can be promoted by reducing the size of the ink cartridge. However, there is a problem in that, if the pump and the buffer chamber are placed at the rear side of the cartridge holder so as to be aligned vertically, even if the ink cartridge is reduced in size, it is difficult to reduce the height of the apparatus.

SUMMARY

An advantage of some aspects of the invention is to provide a liquid supplying apparatus and a liquid ejecting apparatus which is able to suppress a load applied to a movable section of a buffer chamber when performing the choke cleaning and to reduce the height of the apparatus.

According to an aspect of the invention, there is provided a liquid supplying apparatus that includes a liquid supplying path for supplying liquid from an upstream side which becomes a liquid accommodator side accommodating liquid toward a downstream side which becomes a liquid ejecting head side ejecting the liquid; a pump which performs a suction operation of sucking the liquid accommodated in the liquid accommodator and a discharging operation of discharging the sucked liquid toward the liquid ejecting head side; a buffer chamber which is provided at the downstream side of the pump in the liquid supplying path, temporarily stores the liquid discharged from the pump, and has a movable section for supplying the temporarily stored liquid toward the liquid ejecting head side under pressure; and a differential pressure valve which is provided between the buffer chamber and the liquid ejecting head in the liquid supplying path, and is closed to block the liquid supplying path when a negative pressure of the downstream side which becomes the liquid ejecting head side is greater than the pressing force of the upstream side which becomes a buffer chamber side.

According to the configuration, since the differential pressure valve is provided between the buffer chamber and the liquid ejecting head, that is, at the downstream side of the buffer chamber, the liquid supplying path is blocked at the downstream side of the buffer chamber when performing the choke cleaning. Thus, it is possible to reduce the negative pressure extended into the buffer chamber when performing the choke cleaning and suppress the load applied to the movable section.

The liquid supplying apparatus of the invention may further include a suction side one-way valve which is provided between the liquid accommodator and the pump in the liquid supplying path, is opened along with the suction operation of the pump, and is closed along with the discharging operation of the pump; and a discharging side one-way valve which is provided between the pump and the buffer chamber in the liquid supplying path, is closed along with the suction operation of the pump, and is opened along with the discharging operation of the pump, wherein the discharging side one-way valve has a discharging side valve main body which closes and opens the liquid supplying path by being displaced depending on a pressure difference between an upstream side which becomes ae pump side and a downstream side which becomes the buffer chamber side.

According to the configuration, since the discharging side valve main body closes and opens the liquid supplying path by being displaced by the pressure difference between the upstream side and the downstream side, it is possible to effectively perform the opening of the liquid supplying path even by a minor pressure difference.

In the liquid supplying apparatus of the invention, the suction side one-way valve may have a suction side valve main body which is able to block the liquid supplying path, and a biasing member which biases the suction side valve main body in a direction of blocking the liquid supplying path.

According to the configuration, since the suction side one-way valve has the biasing member which biases the suction side valve main body, it is possible to more reliably suppress a flow of liquid from the downstream side to the upstream side, compared to a case which does not include the biasing member.

In the liquid supplying apparatus of the invention, a pressure receiving area in the liquid supplying path of the suction side valve main body may be greater than that in the liquid supplying path of the discharging side valve main body.

According to the configuration, in the liquid supplying path, since the pressure receiving area of the suction side valve main body is greater than the pressure receiving area of the discharging side valve main body, the suction side one-way valve is able to open the liquid supplying path against the biasing force of the biasing member when the pump performs the suction operation.

In the liquid supplying apparatus of the invention, a length of the liquid supplying path between the suction side one-way valve and the pump may be longer than a length of the liquid supplying path between the pump and the discharging side one-way valve.

According to the configuration, since the length of the liquid supplying path between the suction side one-way valve and the pump is longer than the length of the liquid supplying path between the pump and the discharging side one-way valve, a flow path resistance between the suction side one-way valve and the pump becomes greater than that between the pump and the discharging side one-way valve. As a result, it is possible to more reliably suppress a flow of liquid from the pump toward the side of the liquid accommodator.

In the liquid supplying apparatus of the invention, the pump may be a diaphragm type pump which has a pump concave section provided on a first surface of a flow path forming member forming a plate shape, and a diaphragm which is formed so as to surround the pump chamber by covering the opening portion of the pump concave section, the discharging side one-way valve may have a discharging side valve chamber that is formed so as to be surrounded and formed by a discharging side concave section provided on a second surface of an opposite side of the first surface of the flow path forming member and a flexible member attached to the flow path forming member so as to cover the opening portion of the discharging side concave section, the pump concave section and the discharging side concave section may be provided so as to overlap with each other in a vertical direction, and the liquid supplying path may be constituted by a through hole provided in the flow path forming member so as to communicate with the pump concave section and the discharging side concave section.

According to the configuration, since the pump concave section and the discharging side concave section of the discharging side one-way valve are provided in the flow path forming member so as to overlap with each other in the vertical direction, the height of the liquid supplying apparatus can be reduced. Furthermore, by using the through hole communicating with the pump concave section and the discharging concave section as the liquid supplying path, it is possible to shorten the length of the liquid supplying path between the pump and the discharging side one-way valve and reduce the flow path resistance.

According to another aspect of the invention, there is provided a liquid ejecting apparatus which includes a liquid ejecting head that ejects liquid, and the liquid supplying apparatus mentioned above.

According to the configuration, it is possible to obtain the same effect as that of the liquid supplying apparatus mentioned above.

According to still another embodiment of the invention, there is provided a liquid supplying apparatus that includes a liquid accommodator holder which supports a liquid ejecting head ejecting liquid so as to mount a liquid accommodator that accommodates the liquid, and is placed in a position corresponding to a movement region of a carriage reciprocating along a horizontal scanning direction intersecting a vertical direction; a pump which is placed so as to be aligned with the liquid accommodator holder in a depth direction of the apparatus intersecting the horizontal scanning direction and the vertical direction, and performs a suction operation of sucking the liquid accommodated in the liquid accommodator and a discharging operation of discharging the sucked liquid toward the liquid ejecting head side; and a buffer chamber which is placed so as to be aligned with the liquid accommodator holder in the horizontal scanning direction, and temporarily stores the liquid discharged from the pump.

According to the configuration, since the buffer chamber is placed so as to be aligned with the pump in the horizontal scanning direction intersecting the vertical direction, it is possible to reduce the height of the apparatus compared to a case where the pump and the buffer chamber are placed so as to be aligned with each other in the vertical direction.

In the liquid supplying apparatus of the invention, the liquid accommodator holder may be a cartridge holder to which a black ink cartridge accommodating black ink and a color ink cartridge accommodating color ink are mounted in an attachable and detachable manner, a plurality of pumps and a plurality of buffer chambers may be provided so as to correspond to each color ink, and a black buffer chamber, which is the buffer chamber for storing black ink, may have a storage capacity greater than that of a color buffer chamber which is the buffer chamber for storing the color ink.

According to the configuration, since the black buffer chamber has a storage capacity greater than that of the color buffer chamber, it is possible to increase the maximum supply amount of black ink per unit of time. As a result, even in a case where the consumption amount of black ink per unit of time is increased such as a case of performing the monochrome printing, supply insufficiency of black ink can be suppressed.

In the liquid supplying apparatus of the invention, the cartridge holder and the respective buffer chambers may be placed above the movement region, and the black buffer chamber may be placed above the color buffer chamber.

According to the configuration, since the cartridge holder and the respective buffer chambers are placed above the movement region of the carriage, the supply of ink to the liquid ejecting head can be assisted by a water head difference between each buffer chamber and the liquid ejecting head. In addition, since the black buffer chamber is placed above the color buffer chamber, the water head difference between the black buffer chamber and the liquid ejecting head is increased compared to the color buffer chamber. As a result, even in a case where the consumption of the black ink per unit of time is increased, for example, in the case of performing a monochrome printing, it is possible to effectively supply the black ink because of the great water head difference.

In the liquid supplying apparatus of the invention, the cartridge holder may be mounted with the plurality of color ink cartridges accommodating of the color inks of different colors, a plurality of color buffer chambers may be provided corresponding to the respective color inks and may be placed so as to be aligned with each other in the horizontal scanning direction.

According to the configuration, since the plurality of color buffer chambers are placed so as to be aligned with each other in the horizontal scanning direction, the height of the apparatus can be reduced compared to a case where the plurality of color buffer chambers is placed so as to be aligned with each other in the vertical direction.

According to still another embodiment of the invention, there is provided a liquid ejecting apparatus which includes a liquid ejecting head ejecting liquid, a carriage that supports the liquid ejecting head and reciprocates along a horizontal scanning direction, and the liquid supplying apparatus mentioned above.

According to the configuration, it is possible to obtain the same effect as that of the liquid supplying apparatus mentioned above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
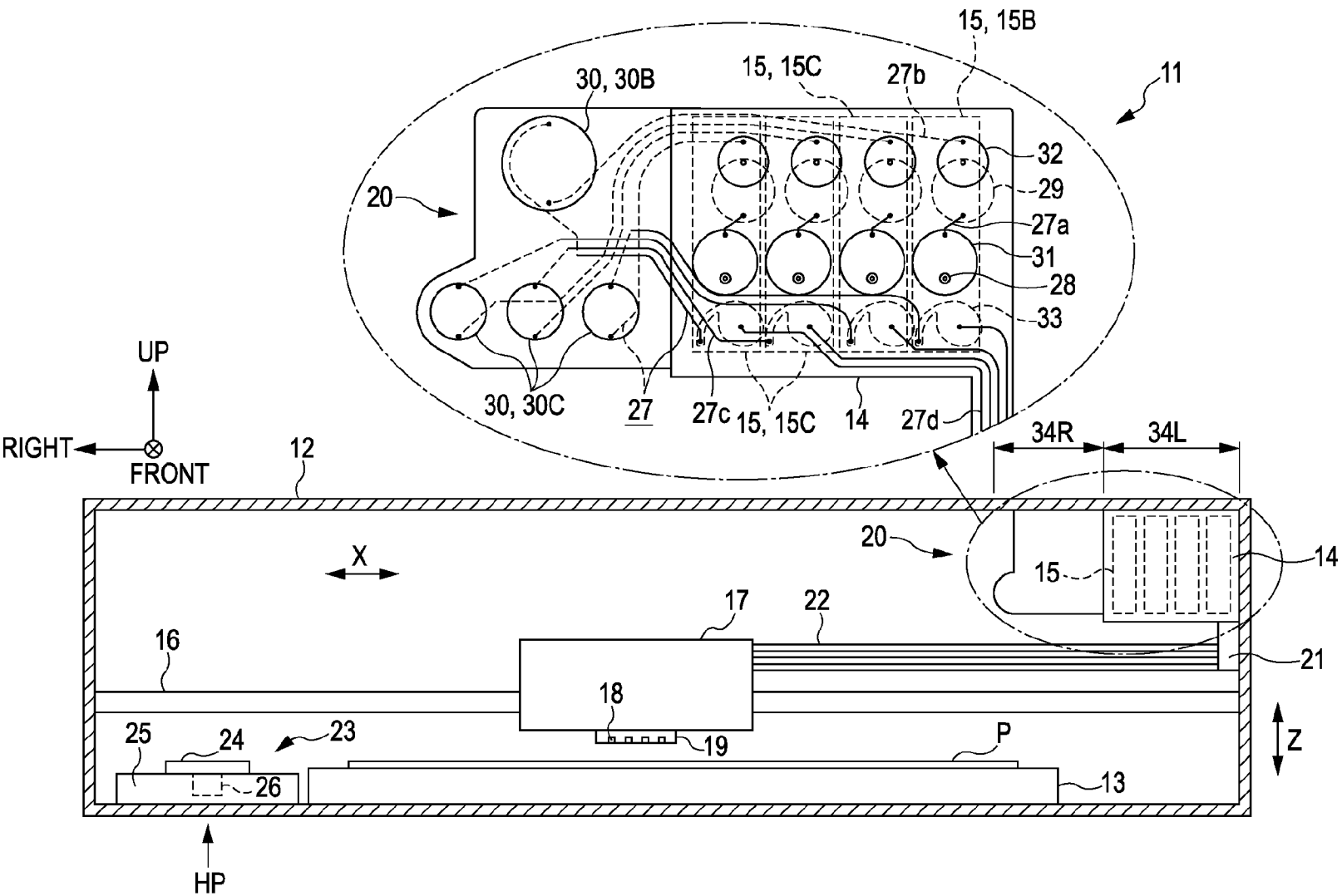
FIG. 1 is a cross-sectional view in which a liquid ejecting apparatus according to an aspect of the invention is viewed from a rear side.

Hereinafter, an embodiment, in which a liquid ejecting apparatus according to the invention is embodied in an ink jet type printer, will be described with reference to the drawings. In addition, in the description mentioned below, the descriptions of "a transverse direction", "a longitudinal direction", and "a vertical direction" are indicated based on directions indicated by arrows in each drawing. Furthermore, in arrows indicating an upward direction, a right direction, and a forward direction in the drawings, those with a point given in a circle (drawings in which the tip of an arrow is viewed from the front) refer to arrows directed from the back of a paper to the surface, and those with a cross listed in a circle (drawings in which the wing of an arrow is viewed from the back) means arrows directed from the surface of a paper to the back.

As shown in FIG. 1, in the printer 11 of the present embodiment, a paper P is transported onto the support member 13 disposed in the frame 12 along a transport direction (the transverse direction in the present embodiment) intersecting a main horizontal scanning direction X which becomes a longer direction of the frame 12 and a vertical direction Z.

A plurality of ink cartridges 15 (15B and 15C) as an example of a liquid accommodator accommodating ink as an example of a liquid is attachably and detachably mounted to a cartridge holder 14 as an example of a liquid accommodator holder disposed at a first end side (left end side in FIG. 1) in the longer direction of the frame 12. In addition, in the present embodiment, one black ink cartridge 15B accommodating black ink and three color ink cartridges 15C accommodating color inks of colors different from each other are mounted to the cartridge holder 14.

A guide shaft 16 extending in the horizontal scanning direction X intersecting the vertical direction Z is installed in the frame 12, and the carriage 17 is supported on the guide shaft 16 in a slidable manner. The carriage 17 reciprocates in the horizontal scanning direction X along the guide shaft 16 by the driving of a carriage motor (not shown).

On a lower surface side of the carriage 17, a liquid ejecting head 19 provided with a plurality of nozzles 18 ejecting ink is supported. In addition, the plurality of nozzles 18 aligned in the transport direction constitutes nozzle rows which eject ink of the same color. Furthermore, a plurality (four rows in the present embodiment) of nozzle rows corresponding to ink of different colors is arranged on the liquid ejecting head 19 along the horizontal scanning direction X.

A liquid supplying apparatus 20 for supplying ink accommodated in the respective ink cartridges 15 to the liquid ejecting head 19 is placed at the rear side of the cartridge holder 14. Furthermore, the liquid supplying apparatus 20 is provided with a connection section 21, and an upstream end of an ink supplying tube 22 having flexibility is connected to the connection section 21 of the liquid supplying apparatus 20. Moreover, the respective ink cartridge 15 is connected to the liquid ejecting head 19 via the liquid supplying apparatus 20 and the ink supplying tube 22.

That is, the printer 11 is a so-called off-carriage type printer which supplies ink from the ink cartridge 15 provided at the frame 12 side to the liquid ejecting head 19 mounted on the carriage 17. Moreover, the printer 11 performs the printing process on the paper P by ejecting ink from the nozzles 18 to the paper P by the driving of a piezoelectric element (not shown) provided in the liquid ejecting head 19.

A second end side (a right end side in FIG. 1) in a movement range along the horizontal scanning direction X of the carriage 17 in the frame 12 is a home position HP. Moreover, in a position corresponding to the home position HP in the frame 12, a maintenance apparatus 23 for performing various maintenance processes on the liquid ejecting head 19 is disposed.

The maintenance apparatus 23 includes a box-shaped cap 24 with a bottom formed with a size corresponding to the liquid ejecting head 19, a lift mechanism 25 for lifting the cap 24, and a suction pump 26 for sucking an inner portion of the cap 24 formed to have the size corresponding to the liquid ejecting head.

The cap 24 is formed so as to surround a closed space area between the liquid ejecting head 19 and a lower surface side to which the nozzles 18 of the liquid ejecting head 19 are opened, by being moved upward and coming into contact with the liquid ejecting head 19 so as to surround openings of nozzles 18 ejecting the ink of the liquid ejecting head 19 placed in the home position HP. Moreover, by driving the suction pump 26 in this state, the negative pressure is generated in the closed space area, and a suction cleaning is performed which discharges ink in the liquid ejecting head 19 through the nozzles 18.

A schematic configuration of the liquid supplying apparatus 20 will be described.

As shown in a partially enlarged view of FIG. 1, the liquid supplying apparatus 20 is provided with liquid supplying paths 27 for supplying ink from an upstream side which becomes the ink cartridge side 15 toward a downstream side which becomes the liquid ejecting head 19 side for each color of ink. Furthermore, an upstream end of each liquid supplying path 27 is a connection section 28 which is inserted into the ink cartridge 15 of the corresponding color, respectively. Furthermore, the downstream end of each liquid supplying path 27 is a connection section 21 to which the upstream end of the ink supplying tube 22 of the corresponding color is connected, respectively.

In the middle of each liquid supplying path 27, a diaphragm type pump 29 is provided, respectively, which performs a suction operation of sucking the ink accommodated in the ink cartridge 15 and a discharging operation of discharging the sucked ink toward the liquid ejecting head 19 side. Furthermore, at the downstream side of the pump 29 in each liquid supplying path 27, buffer 30 (30B and 30C) are provided, respectively, which temporarily stores the ink discharged from the pump 29. That is, in the present embodiment, the liquid supplying apparatus 20 is provided with four pumps 29 and buffers 30, respectively.

A black buffer 30B, which is the buffer 30 for storing the black ink, has a storage capacity greater than that of a color buffer 30C which is the buffer 30 for storing the color ink. Furthermore, the black buffer 30B is placed above the color buffer 30C, and the plurality (three in the present embodiment) of color buffers 30C are placed so as to be aligned in the horizontal scanning direction X.

Between the connection section 28 connected to the ink cartridge 15 and the pump 29 in each liquid supplying path 27, a suction side one-way valve 31 is provided which is opened when the pump 29 performs the suction operation and is closed when the pump 29 performs the discharging operation. Furthermore, between the pump 29 and the buffer 30 in each liquid supplying path 27, a discharging side one-way valve 32 is provided which is closed when the pump 29 performs the suction operation and is opened when the pump performs the discharging operation. In addition, the suction side one-way valve 31 and the pump 29 communicate with each other through a first flow path 27*a* constituting the liquid supplying path 27. Furthermore, the discharging side one-way valve 32 and the buffer 30 communicate with each other through a second flow path 27*b* constituting the liquid supplying path 27.

In addition, between the buffer 30 and the ink supplying tube 22 connected to the liquid ejecting head 19 in each liquid supplying path 27, a choke valve 33 as an example of a differential pressure valve is provided. The choke valve 33 is closed to block the liquid supplying path 27 when the negative pressure of the downstream side which becomes the liquid ejecting head 19 side becomes greater than the pressurization force of the upstream side which becomes the buffer 30 side. In addition, the buffer 30 and the choke valve 33 communicate with each other through a third flow path 27*c* constituting the liquid supplying path 27, and the choke valve 33 and the connection section 21 communicate with each other through a fourth flow path 27*d* constituting the liquid supplying path 27.

Thus, when the suction cleaning is executed, the negative pressure at the downstream side of the choke valve 33 is increased, whereby the choke valve 33 is closed. Furthermore, the suction cleaning is further continued in the state where the liquid supplying path 27 is blocked by the closed choke valve 33, whereby the negative pressure in the liquid ejecting head 19 is increased. Moreover, after that, when the pump 29 performs the discharging operation, the pressure of the upstream side of the choke valve 33 rises, and the choke valve 33 is opened. As a result, along with ink discharged by the pump 29, air bubbles accumulated in the liquid ejecting head 19, the thickened ink or the like are vigorously discharged through the nozzles 18. That is, the choke cleaning, which is a kind of discharge cleaning, is executed by the maintenance apparatus 23 and the choke valve 33.

In addition, the cartridge holder 14 is placed in a position (specifically, an upper part of a left end side of a movement region) corresponding to a movement region of the carriage 17 along the horizontal scanning direction X. Furthermore, the pump 29, the suction side one-way valve 31, the discharging side one-way valve 32, and the choke valve 33 are placed in a first region 34L which becomes the rear side of the cartridge holder 14 so as to be aligned with the cartridge holder 14 in a depth direction (the transverse direction in the present embodiment) of the apparatus intersecting the horizontal scanning direction X and the vertical direction Z. Meanwhile, each buffer 30 is placed in a second region 34R situated at the right side of the first region 34L so as to be aligned with the cartridge holder 14 in the horizontal scanning direction X.

Next, a structure of the liquid supplying apparatus 20 will be described.

Figure 2:
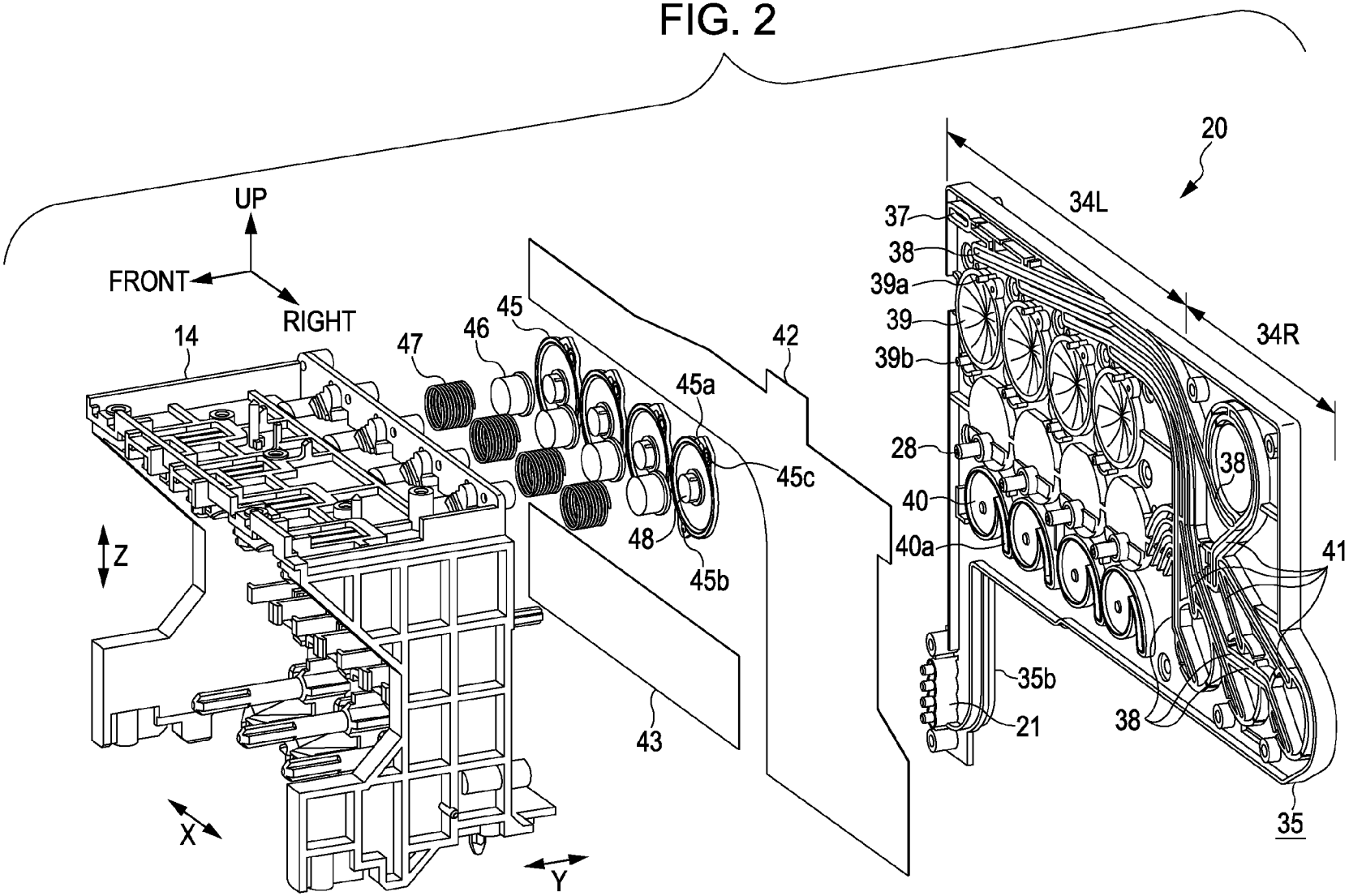
FIG. 2 is an exploded view of a front side portion of a liquid supplying apparatus according to the aspect of the invention.

As shown in FIG. 2, the liquid supplying apparatus 20 includes a flow path forming member 35 forming a plate shape to be placed behind the cartridge holder 14, in a depth direction Y (the transport direction) of the apparatus intersecting (perpendicular thereto in the present embodiment) the horizontal scanning direction X and the vertical direction Z.

On a first surface (a front in the present embodiment) of the flow path forming member 35, in a position corresponding to the first region 34L, one fluid flow path forming concave section 37 forming a groove shape, four second flow path forming concave sections 38 forming a groove shape, four pump concave sections 39 forming an approximately circular shape when viewed from a plane, and four choke valve concave sections 40 when viewed from plane forming an approximately circular shape are formed so as to be aligned from the upper side to the lower side. Furthermore, a downstream end of a groove-like introduction concave section 40*a* is connected to a portion near the upper end of the respective choke valve concave sections 40, respectively. In addition, the respective four pump concave sections 39 and choke valve concave sections 40 are placed so as to be aligned in the horizontal scanning direction X, respectively.

Furthermore, in a position corresponding to the second region 34R in front of the flow path forming member 35, a groove-like second flow path forming concave section 38 continued from the first region 34L, and four third flow path forming concave sections 41 forming the groove shape in the same manner.

From the front of the flow path forming member 35, four connection sections 28 forming a cylindrical shape from a position between the pump concave section 39 and the choke valve concave section 40 in the vertical direction Z are projected so as to be aligned in the horizontal scanning direction X. Furthermore, in a position equivalent to an outer peripheral portion of the opening of the respective pump concave sections 39 in front of the flow path forming member 35, positioning protrusions 39*a* and 39*b* projected forward are formed, respectively.

A first film member 42 is welded to the front side of the flow path forming member 35 so as to cove the fluid flow path forming concave section 37, the second flow path forming concave section 38, and the third flow path concave section 41. Moreover, the second flow path 27*b* (see FIG. 1) is surrounded and formed by the second flow path forming concave section 38 and the first film member 42, and the upstream side portion of the third flow path 27*c* (see FIG. 1) is surrounded and formed by the third flow path forming concave section 41 and the first film member 42.

Furthermore, a second film member 43 is welded to the front side of the so as to cover the choke valve concave section 40 and the introduction concave section 40*a* at the front side of the flow path forming member 35. In addition, from a left lower portion of the flow path forming member 35, an extension section 35*b* is extended downward, and the connection section 21 is projected forward at the tip side of the extension section 35*b*.

In a position corresponding to each pump concave section 39 between the flow path forming member 35 and the cartridge holder 14, a diaphragm 45 forming an approximately circular shape when viewed from a plane, a spring seat 46 forming an approximately cylindrical shape, and a first coil spring 47 are placed so as to be aligned from the rear side to the front side, respectively. In addition, a protrusion section 48 is projected from the vicinity of the center at the front side of each diaphragm 45. Moreover, the projection section 48 is engaged with an inner peripheral surface of the spring seat 46, and an outer peripheral surface of the spring seat 46 is engaged with the first coil spring 47.

In an outer edge portion of each diaphragm 45, positioning holes 45*a* and 45*b* each corresponding to positioning protrusions 39*a* and 39*b* of the flow path forming member 35 are formed. Furthermore, through holes 45*c* are formed near the positioning hole 45*a* in the outer edge portion of each diaphragm 45, respectively. Moreover, the diaphragm 45 becomes a form that covers the pump concave section 39 when the positioning holes 45*a* and 45*b* are inserted into the positioning protrusions 39*a* and 39*b* of the flow path forming member 35 and are positioned.

Figure 3:
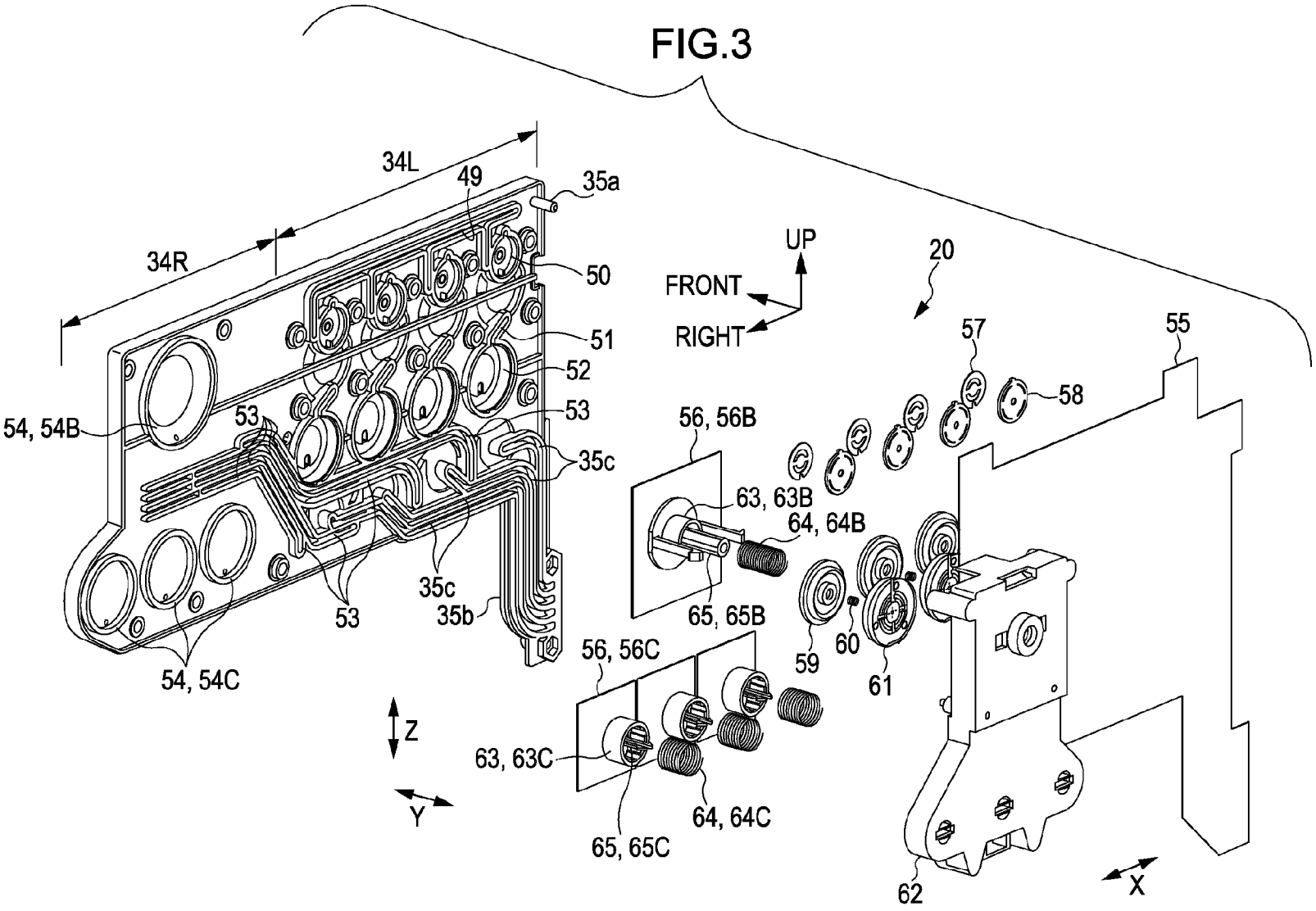
FIG. 3 is an exploded perspective view of a rear side portion of the liquid supplying apparatus according to an aspect of the invention.

As shown in FIG. 3, in a position corresponding to the first region 34L on a second surface (a back in the present embodiment) of an opposite side of the first surface of the flow path forming member 35, a fluid flow path forming concave section 49 forming a groove shape, and four discharging side concave sections 50 forming an approximately circular shape when viewed from a plane are formed. Furthermore, in the lower part of the discharging side concave section 50 in the back of the flow path forming member 35, four first flow path forming concave sections 51 forming a groove shape, four suction side concave sections 52 forming an approximately circular shape when viewed from a plane, and four third flow path forming concave sections 53 forming a groove shape are formed so as to be aligned form the upper side to the lower side. In addition, the respective four discharging side concave sections 50, the first flow path forming concave section 51, and the suction side concave section 52 are placed so as to be aligned in the horizontal scanning direction X, respectively.

Furthermore, in a position corresponding to the second region 34R in the back of the flow path forming member 35, a groove-like third flow path forming concave section 53 continued from the first region 34L, and four buffer concave sections 54 (54B and 54C) forming an approximately circular shape when viewed from a plane are formed. In addition, three buffer concave sections 54C corresponding to the color ink are placed so as to be aligned in the horizontal scanning direction X, and one buffer concave section 54B corresponding to the black ink is placed above the buffer concave section 54C. Moreover, an opening area of the buffer concave section 54B is greater than those of three buffer concave sections 54C.

From a left upper portion in the back of the flow path forming member 35, one supplying section 35*a* for supplying fluid such as air from the rear side of the flow path forming member 35 toward the front side thereof is projected backward. Furthermore, in a left lower portion in the back of the flow path forming member 35, four connection flow path forming members 35*c* forming a groove shape extended toward the extension section 35*b* are formed.

A third film member 55 as an example of a flexible member is welded to the rear side of the flow path forming member 35 so as to cover the fluid flow path forming concave section 49, the discharging side concave section 50, the first flow path forming concave section 51, the suction side concave section 52, the third flow path concave section 53, and the connection flow path forming concave section 35*c*. Furthermore, fourth film members 56 (56B and 56C) are welded to the rear side of the flow path forming member 35 so as to cover the buffer concave sections 54 (54B and 54C), respectively.

Moreover, the first flow path 27*a* (see FIG. 1) is surrounded and formed by the first flow path forming concave section 51 and the third film member 55, and the downstream side section of the third flow path 27*c* (see FIG. 1) is surrounded and formed by the third flow path forming concave section 53 and the third film member 55. Furthermore, the fourth flow path 27*d* (see FIG. 1) is surrounded and formed by the connection flow path forming concave section 35*c* and the third film member 55.

In a position corresponding to each discharging side concave section 50 between the flow path forming member 35 and the third film member 55, a discharging side valve main body 57 forming approximately circular shape when viewed from a plane and an approximately disc-shaped first fixing member 58 are provided so as to be aligned from the front side to the rear side, respectively.

Furthermore, in a position corresponding to the respective suction side concave sections 52 between the flow path forming member 35 and the third film member 55, a suction side valve main body 59 covering the suction side concave section 52, a second coil spring 60 as an example of the biasing member, an approximately disc-shaped second fixing member 61 are provided so as to be aligned from the front side to the rear side, respectively. Moreover, the respective second coil springs 60 is configured so that a front end thereof comes into contact with the suction side valve main body 59 and a rear end thereof comes into contact with the second fixing member 61, whereby the corresponding suction side valve main body 59 is biased toward the bottom surface side of the suction side concave section 52.

In a position corresponding to the second region 34R at the rear side of the flow path forming member 35, the cover member 62 is assembled so as to interpose the fourth film member 56 therebetween. Moreover, between the fourth film member 56 and the cover member 62, pressure receiving members 63 (63B and 63C) and third coil springs 64 (64B and 64C) to be placed in positions each corresponding to the buffer concave sections 54 (54B and 54C) are provided so as to be aligned from the front side to the rear side.

The front sides of the respective pressure receiving members 63 are formed in a plane shape and are fixed to the vicinity of the center of the rear side of the respectively corresponding fourth film member 56. Furthermore, locking sections 65 (65B and 65C) are projected backward from the vicinity of the center of the respective pressure receiving members 63 (63B and 63C). Moreover, the third coil springs 64 (64B and 64C) are locked to the locking sections 65 (65B and 65C). Furthermore, the respective third coil springs 64 are configured so that a front end thereof comes into contact with the pressure receiving member 63 and a rear end thereof comes into contact with the cover member 62, thereby biasing the corresponding fourth film member 56 to the bottom surface side of the buffer concave section 54.

Figure 4:
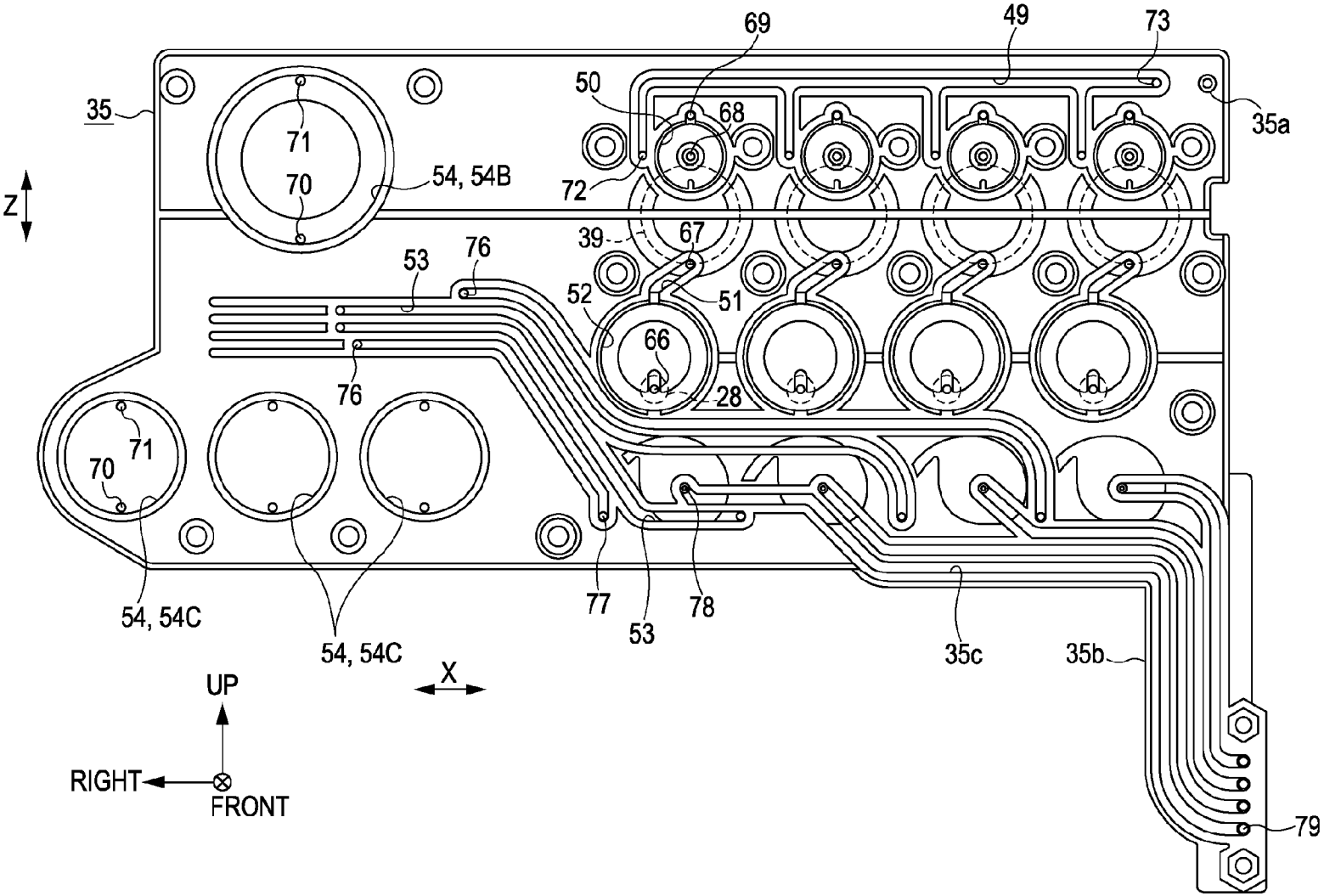
FIG. 4 is a rear view of a flow path forming member.

As shown in FIG. 4, on the bottom surface of the respective suction side concave section 52 in the flow path forming member 35, through holes 66 are formed in positions each corresponding to the connection section 28. Furthermore, in the flow path forming member 35, in position corresponding to the vicinity of the lower end of each pump concave section 39, through holes 67 are formed, respectively, in positions corresponding to the vicinity of the upper end of each pump concave section 39, and through holes 68 are formed, respectively. Moreover, the upstream end of the first flow path forming concave section 51 is connected to the upper end portion of the suction side concave section 52, and the downstream end of the first flow path forming concave section 51 communicates with the through hole 67. In addition, in the flow path forming member 35, the pump concave section 39 and the discharging side concave section 50 are provided so as to overlap with each other in the vertical direction, and the through hole 68 is provided near the center of the bottom surface of the discharging side concave section 50 so as to communicate with the pump concave section 39 and the discharging side concave section 50.

The through holes 69 are formed near the upper end of each discharging side concave side 50 in the flow path forming member 35, respectively. Furthermore, in the flow path forming member 35, through holes 70 are formed near the lower end of each buffer concave section 54, respectively, and through holes 71 are formed near the upper end of each buffer concave section 54, respectively.

In addition, the flow path forming member 35 is formed with a through hole 72 each communicating with the downstream end of the fluid flow path forming concave section 49 in a position aligned to each discharging side concave section 50, and a left upper portion of the flow path forming member 35 is formed with one through hole 73 communicating with the upstream end of the fluid flow path forming concave section 49.

Figure 5:
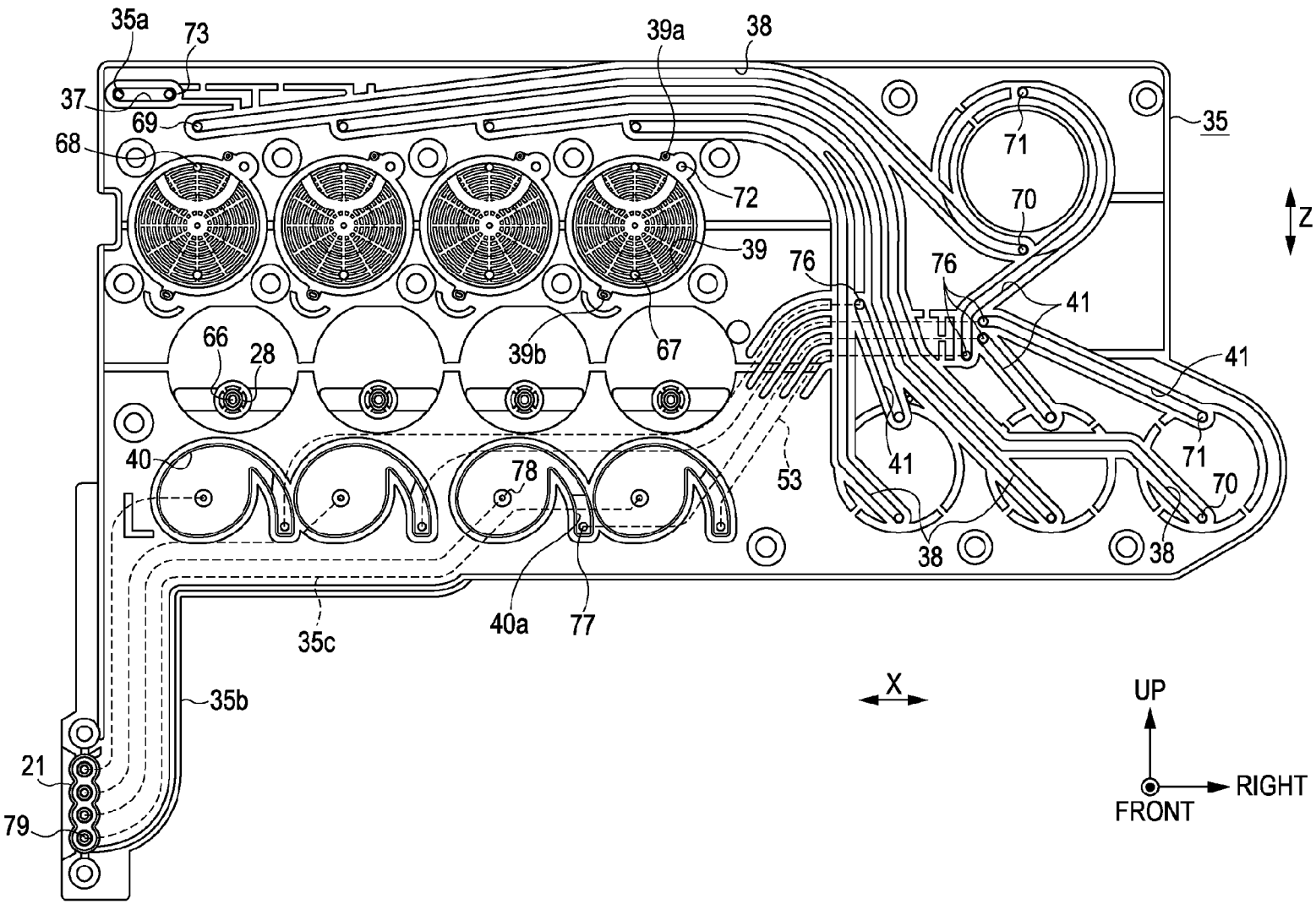
FIG. 5 is a front view of the flow path forming member.

As shown in FIG. 5, in front of the fluid path forming member 35, the upstream end of the second flow path forming concave section 38 communicates with the through hole 69, and the downstream end of the second flow path forming concave section 38 communicates with the through hole 70. Furthermore, the upstream end of the third flow path forming concave section 41 communicates with the through hole 71.

In positions corresponding to the downstream ends of each third flow path forming concave section 41 in the flow path forming member 35, through holes 76 for causing the downstream end of the third flow path forming concave section 41 to communicate with the upstream end of the third flow path forming concave section 53 are formed, respectively. Furthermore, in positions communicating with the upstream ends of each introduction concave section 40*a* in the flow path forming member 35, through holes 77 are formed, respectively. Moreover, the upstream end of the third flow path forming concave section 53 communicates with the through hole 76, and the downstream end of the third flow path forming concave section 53 communicates with the through hole 77.

Through holes 78 are formed near the center of the bottom surface of each choke valve concave section 40 in the flow path forming member 35, respectively. Furthermore, in a position corresponding to the connection section 21 in the flow path forming member 35, four through holes 79 aligned in the vertical direction are formed. Moreover, the upstream end of the connection flow path forming concave section 35*c* communicates with the through hole 78, and the downstream end of the connection flow path forming concave section 35*c* communicates with the through hole 79.

In addition, in the present embodiment, the through holes 66 to 71 and 76 to 79 constituted the liquid supplying path 27 (see FIG. 1). Furthermore, the through hole 67 constitutes the first flow path 27*a* (see FIG. 1), and the through holes 69 and 70 constitute the second flow path 27*b* (see FIG. 1). Furthermore, the through holes 71, 76, and 77 and the introduction concave section 40*a* constitute the third flow path 27*c* (see FIG. 1), and the through holes 78 and 79 constitute the fourth flow path 27*d* (see FIG. 1).

Furthermore, each through hole 72 is situated near the positioning protrusion 39*a* in an outer peripheral portion of the opening of the pump concave section 39 in front of the flow path forming member 35. In addition, the upstream end of the fluid flow path forming concave section 37 communicates with the supplying section 35*a*, and the downstream end of the fluid flow path forming concave section 37 communicates with the through hole 73.

Figure 6:
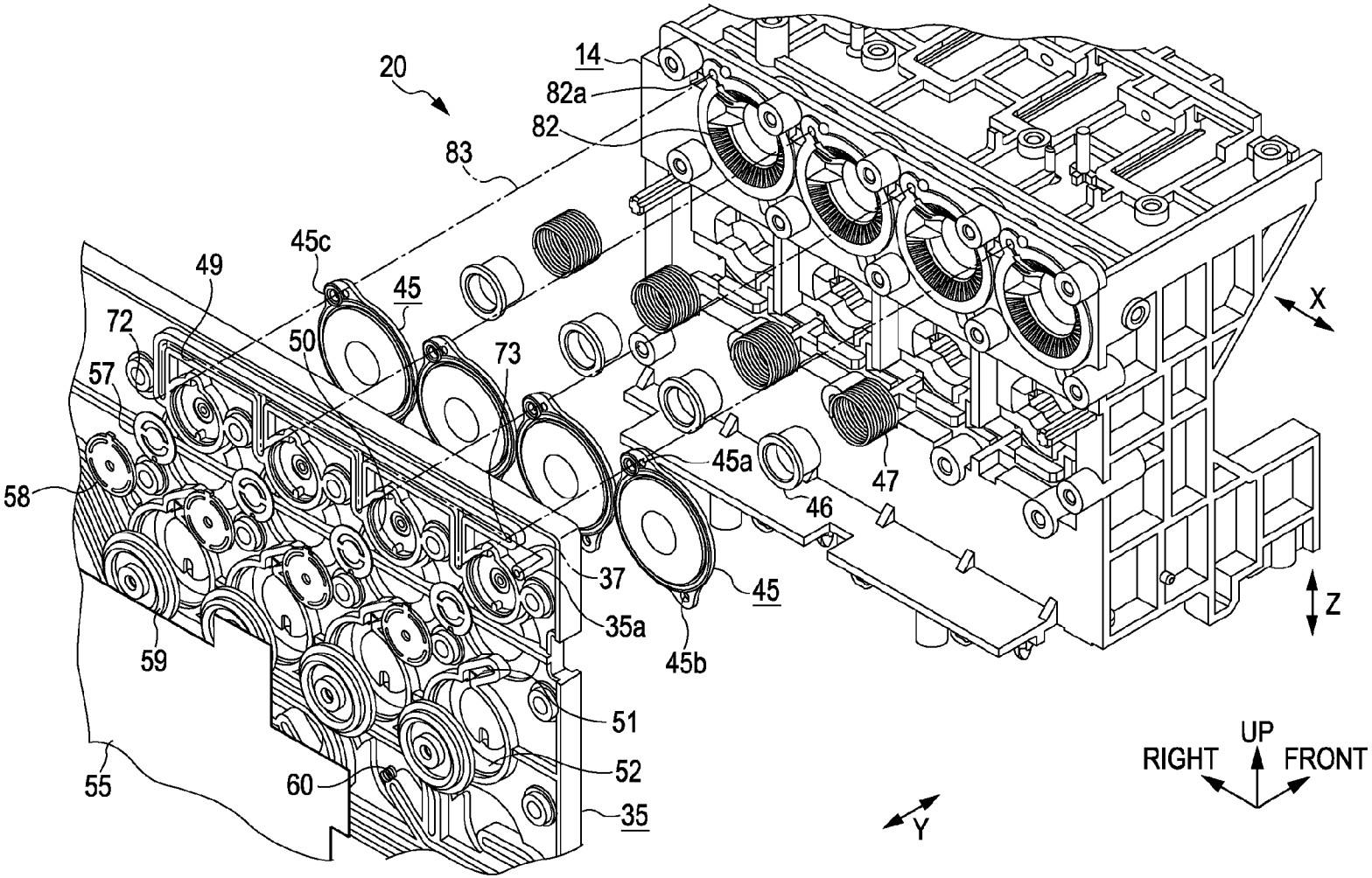
FIG. 6 is an exploded perspective view for describing a configuration of a pump.

As shown in FIG. 6, in the rear of the cartridge holder 14, a plurality (four in the present embodiment) of fluid chamber concave section 82 is formed so as to be aligned in the horizontal scanning direction X, and fluid introduction sections 82*a* are provided in positions coming into contact with each fluid chamber concave section 82. In addition, the spring seat 46 and the first coil spring 47 are accommodated in a space area surrounded and formed by the diaphragm 45 and the pump concave section 39.

Moreover, the through hole 45*c* formed in the diaphragm 45, the fluid introduction section 82*a* formed in the rear of the cartridge holder 14, the supplying section 35*a* formed in the flow path forming member 35, the fluid flow path forming concave section 37, the trough hole 73, the fluid flow path forming concave section 49, and the through hole 72 constitute the fluid flow path 83.

Figure 7:
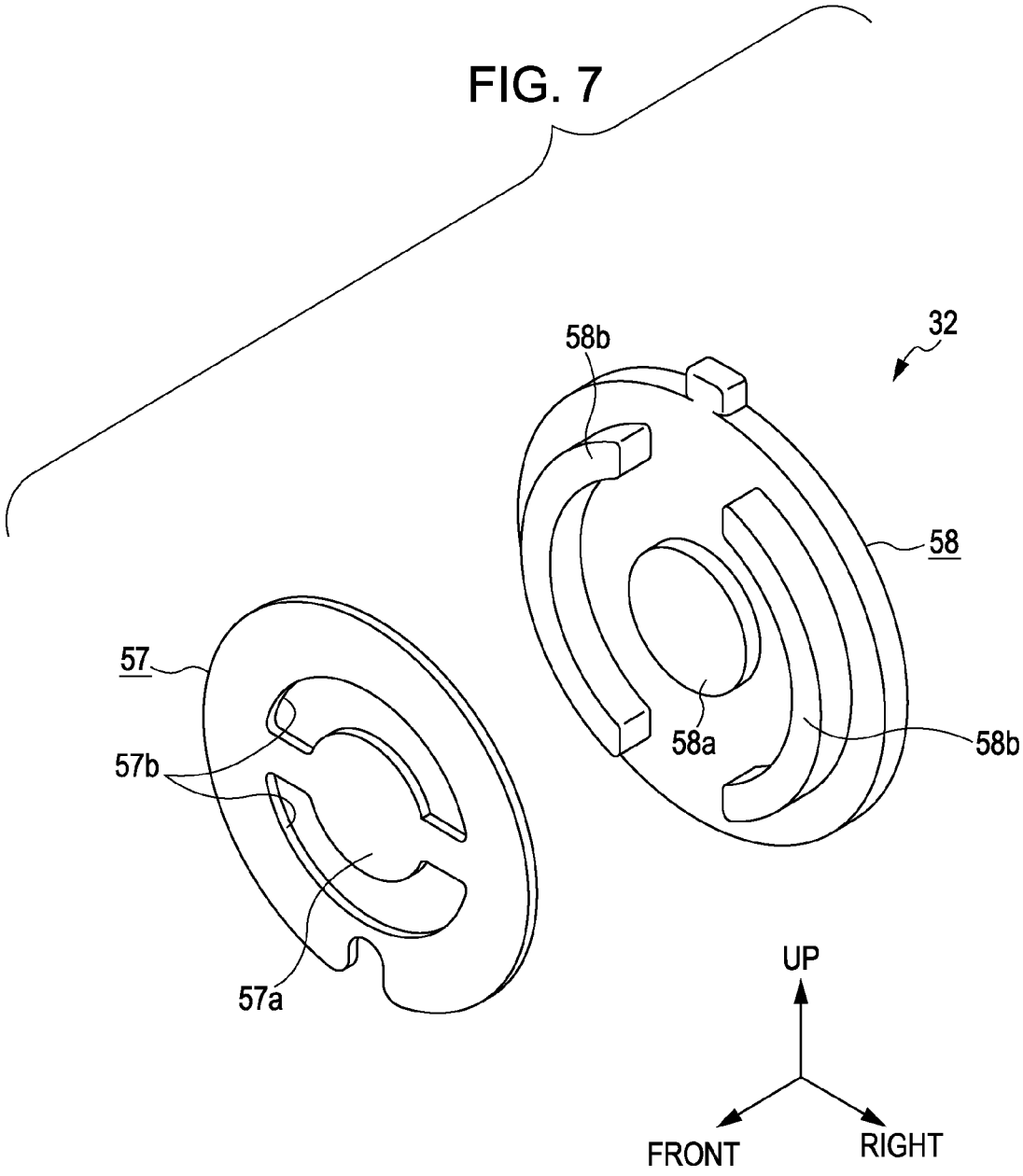
FIG. 7 is an exploded perspective view for describing a configuration of a discharging side one-way valve.

As shown in FIG. 7, a portion near the center of the discharging side valve main body 57 constituting the discharging side one-way valve 32 is a deflection displaceable contact section 57*a*, and two communicating holes 57*b* having an approximately arc shape when viewed from the front are formed around the contact section 57*a*. Furthermore, at the front side which becomes the discharging side valve main body 57 side of the first fixing member 58 constituting the discharging side one-way valve 32, a first cylindrical protrusion section 58*a* and two second protrusion sections 58*b* having an approximately arc shape when viewed from the front are formed. Moreover, the second protrusion section 58*b* of the first fixing member 58 comes into contact with an outer edge portion of the discharging side valve main body 57, whereby the discharging side valve main body 57 is fixed.

Figure 8:
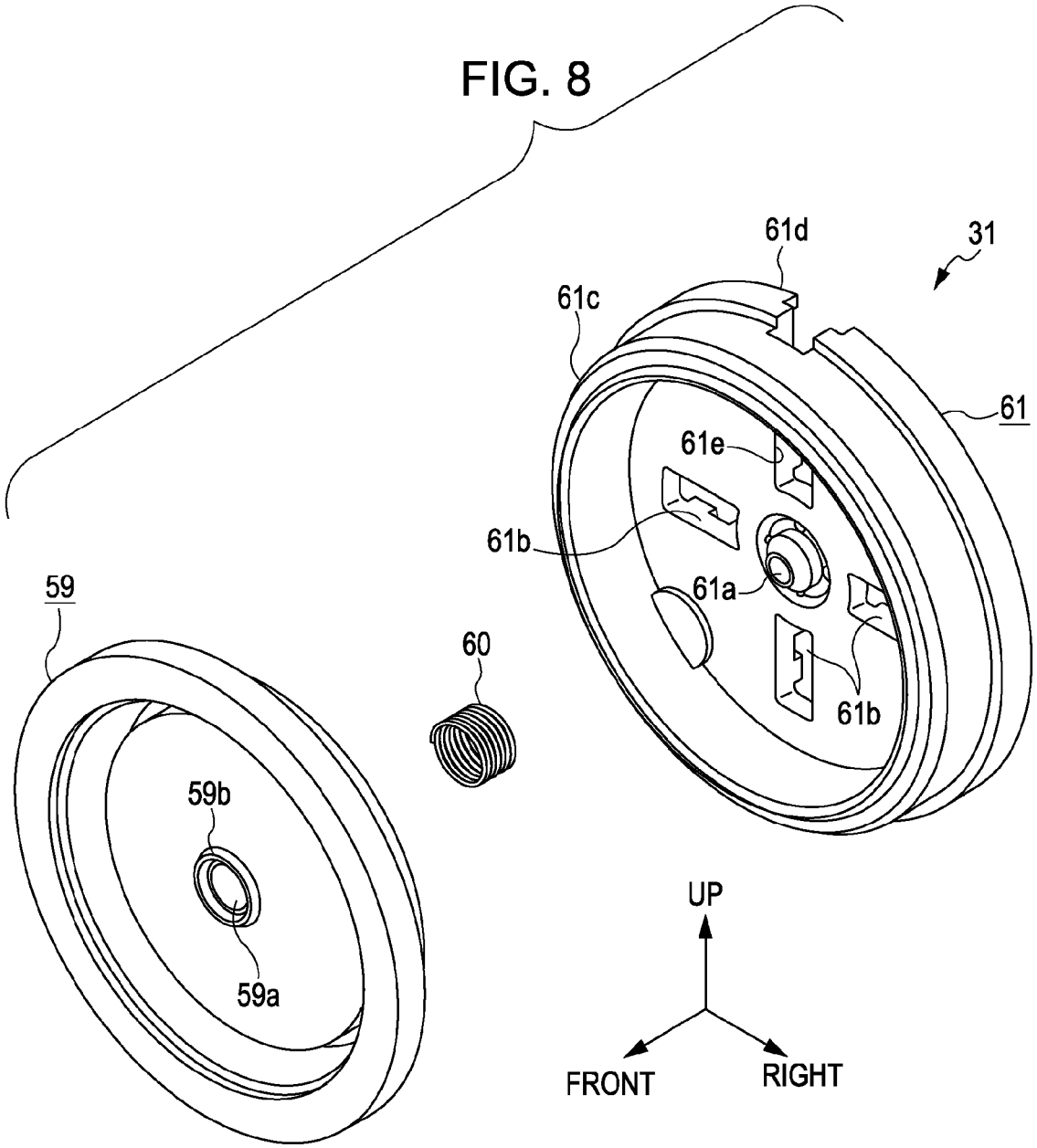
FIG. 8 is an exploded perspective view for describing a configuration of a suction side one-way valve.

As shown in FIG. 8, in the center of the suction side valve main body 59 constituting the suction side one-way valve 31, a through hole 59*a* of a circular shape when viewed from the front is formed. Furthermore, the suction side valve main body 59 is formed with a annular protrusion section 59*b* projected forward so as to surround the through hole 59*a*.

In the center of the second fixing member 61 constituting the suction side one-way valve 31, a communication hole 61*a* having a circular shape when viewed from the front is formed, and in the left part, the right part and the lower part of the communication hole 61*a*, communication holes 61*b* having an approximately rectangular shape when viewed from the front are formed. Furthermore, from the outer edge section of the second fixing member 61, an annular protrusion section 61*c* is projected forward, and an annular protrusion section 61*d* is projected rearward.

A communication hole 61*e* is formed above the communication hole 61*a* in the second fixing member 61 in the manner of notching a part of the annular protrusion section 61*d*. Moreover, the annular protrusion section 61*c* of the second fixing member 61 comes into contact with the outer edge portion of the suction side valve main body 59, whereby the suction side valve main body 59 is fixed.

Next, a configuration and an operation of the pump 29 will be described.

Figure 9:
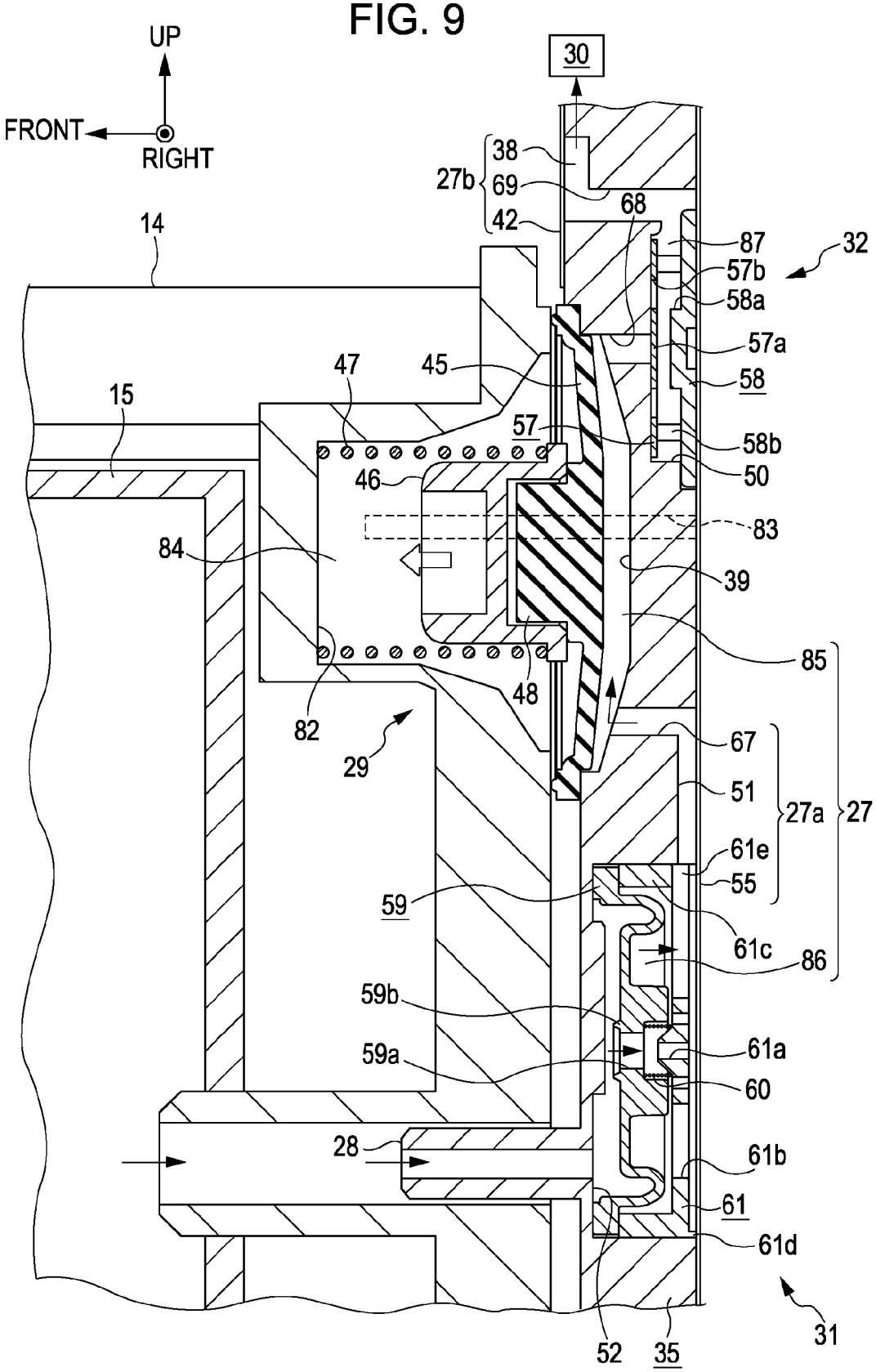
FIG. 9 is a cross-sectional view for describing a suction operation of a pump.

As shown in FIG. 9, the pump 29 includes the diaphragm 45, the spring seat 46, and the first coil spring 47. Furthermore, the pump 29 includes a fluid chamber concave section 82 formed in the rear of the cartridge holder 14, and an operation fluid chamber 84 surrounded and formed by the diaphragm 45. Furthermore, the pump 29 includes a pump chamber 85 which is surrounded and formed by the pump concave section 39 formed in front of the flow path forming member 35 and the diaphragm 45 attached to the flow path forming member 35 so as to cover the opening portion of the pump concave section 39. In addition, the pump chamber 85 constitutes a part of the liquid supplying path 27.

In the operation fluid chamber 84, the first coil spring 47 biasing the diaphragm 45 toward the pump chamber 85 side, and the spring seat 46 placed between the first coil spring 47 and the diaphragm 45 are accommodated. Furthermore, a pressure adjusting device (not shown) including a decompression pump or the like and an air opening mechanism (not shown) are connected to the operation fluid chamber 84 through the fluid flow path 83. The pressure adjusting device is configured so as to generate the negative pressure in the operation fluid chamber 84, and the air opening mechanism is configured so as to open the inner portion of the operation fluid chamber 84 to air to cancel the negative pressure state.

Figure 10:
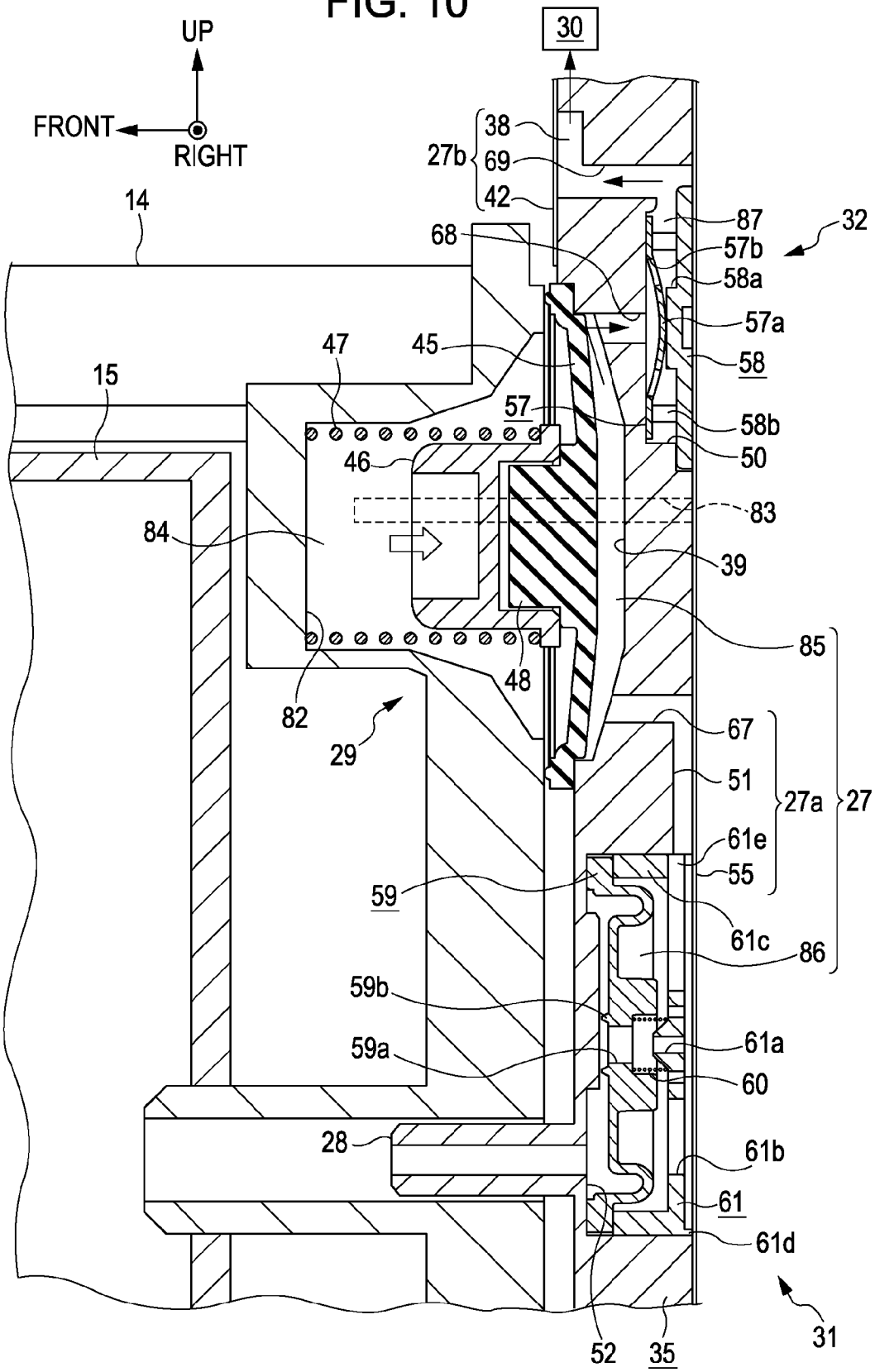
FIG. 10 is a cross-sectional view for describing a discharging operation of the pump.

Moreover, when the negative pressure is generated in the operation fluid chamber 84 along with the driving of the pressure adjusting device, the diaphragm 45 is displaced in a direction (front in the present embodiment) of expanding the volume of the pump chamber 85 against the biasing force of the first coil spring 47, whereby the pump 29 performs the suction operation. Furthermore, when the air opening mechanism is driven to open the inner portion of the operation fluid chamber 84 to air after the suction operation, as shown in FIG. 10, the diaphragm 45 is displaced in a direction (rear in the present embodiment) of reducing the volume of the pump chamber 85 by the biasing force of the first coil spring 47, whereby the pump 29 performs the discharging operation.

Next, a configuration and an operation of the suction side one-way valve 31 will be described.

The suction side one-way valve 31 includes the suction side valve main body 59, the second coil spring 60, and the second fixing member 61. Furthermore, the suction side one-way valve 31 includes a suction side valve chamber 86 which is surrounded and formed by the suction side concave section 52 formed in the rear of the flow path forming member 35 and the third film member 55. In addition, the suction side valve chamber 86 constitutes a part of the liquid supplying path 27. The suction side valve chamber 86 is partitioned into an upstream side portion (front side in the present embodiment) and a center portion by the suction side valve main body 59 capable of blocking the liquid supplying path 27, and is partitioned into a center portion and a downstream side portion (rear side in the present embodiment) by the second fixing member 61.

The partitioned upstream side portion and center portion of the suction side valve chamber 86 can communicate with each other through the through hole 59*a* formed in the suction side valve main body 59, and the partitioned center portion and the downstream side portion of the suction side valve chamber 86 can communicate with each other through the communication holes 61*a*, 61*b*, and 61*e* formed in the second fixing member 61. In addition, the second coil spring 60 is placed between the suction side valve main body 59 and the second fixing member 61 in the transverse direction, and biases the suction side valve main body 59 so that the annular protrusion section 59*b* comes into contact with the inner portion of the bottom surface of the suction side concave section 52 and the upstream side portion and the center portion of the suction side valve chamber 86 do not communicate with each other, that is, in a direction of blocking the liquid supplying path 27.

Moreover, when the pump 29 performs the suction operation, ink in the suction side valve chamber 86 is sucked into the pump chamber 85 through the first flow path 27*a*, and the negative pressure is generated in the suction side valve chamber 86. Then, as shown in FIG. 9, the annular protrusion section 59*b* of the suction side valve main body 59 is separated from the inner portion of the bottom surface of the suction side concave section 52 against the biasing force of the second coil spring 60, and the upstream side portion and the center portion of the suction side valve chamber 86 communicate with each other. That is, the suction side one-way valve 31 is opened to open the liquid supplying path 27. As a result, ink in the ink cartridge 15 is supplied toward the pump chamber 85 side through the connection section 28.

Meanwhile, when the pump 29 performs the discharging operation, ink in the pump chamber 85 flows in the suction side valve chamber 86 through the first flow path 27*a*. As a result, the negative pressure in the suction side valve chamber 86 is canceled, and, as shown in FIG. 10, the annular protrusion section 59*b* of the suction side valve main body 59 comes into contact with the bottom surface of the suction side concave section 52 by the biasing force of the second coil spring 60. That is, the suction side one-way valve 31 is closed to block the liquid supplying path 27.

Next, a configuration and an operation of the discharging side one-way valve 32 will be described.

The discharging side one-way valve 32 includes the discharging side valve main body 57 and the first fixing member 58. Furthermore, the discharging side one way valve 32 includes a discharging side valve chamber 87 which is surrounded and formed by the discharging side concave section 50 formed in the rear of the flow path forming member 35 and the third film member 55 attached to the flow path forming member 35 so as to cover the opening portion of the discharging side concave section 50. In addition, the discharging side valve chamber 87 constitutes a part of the liquid supplying path 27.

The discharging side valve chamber 87 and the pump chamber 85 communicate with each other through the trough hole 68, but the opening of the through hole 68 to the discharging side valve chamber 87 is always blocked by the contact section 57*a* of the discharging side valve main body 57. Furthermore, the contact section 57*a* of the discharging side valve main body 57 is displaced depending on the pressure difference between the upstream side which becomes the pump 29 side and the downstream side which becomes the buffer 30 side, thereby blocking and opening the through hole 68 constituting the liquid supplying path 27.

Specifically, when the pump 29 performs the discharging operation, since ink in the pump chamber 85 is discharged under pressure through the through hole 68, the contact section 57*a* is displaced to the first fixing member 58 side by the pressing force of ink. That is, the discharge side one-way valve 32 is opened to open the liquid supplying path 27. Then, ink flows in the discharging side valve chamber 87 through the communication hole 57*b*, and the inflow ink is supplied to the buffer 30 situated at the downstream side through the second flow path 27*b*.

Meanwhile, when the pump 29 performs the suction operation, since ink in the discharging side valve chamber 87 is sucked into the pump chamber 85 side through the through hole 68, as shown in FIG. 9, the contact section 57*a* is displaced to the through hole 68 side to block the through hole 68. That is, the discharging side one-way valve 32 is closed to block the liquid supplying path 27.

Next, a configuration and an operation of the buffer 30 will be described.

Figure 11:
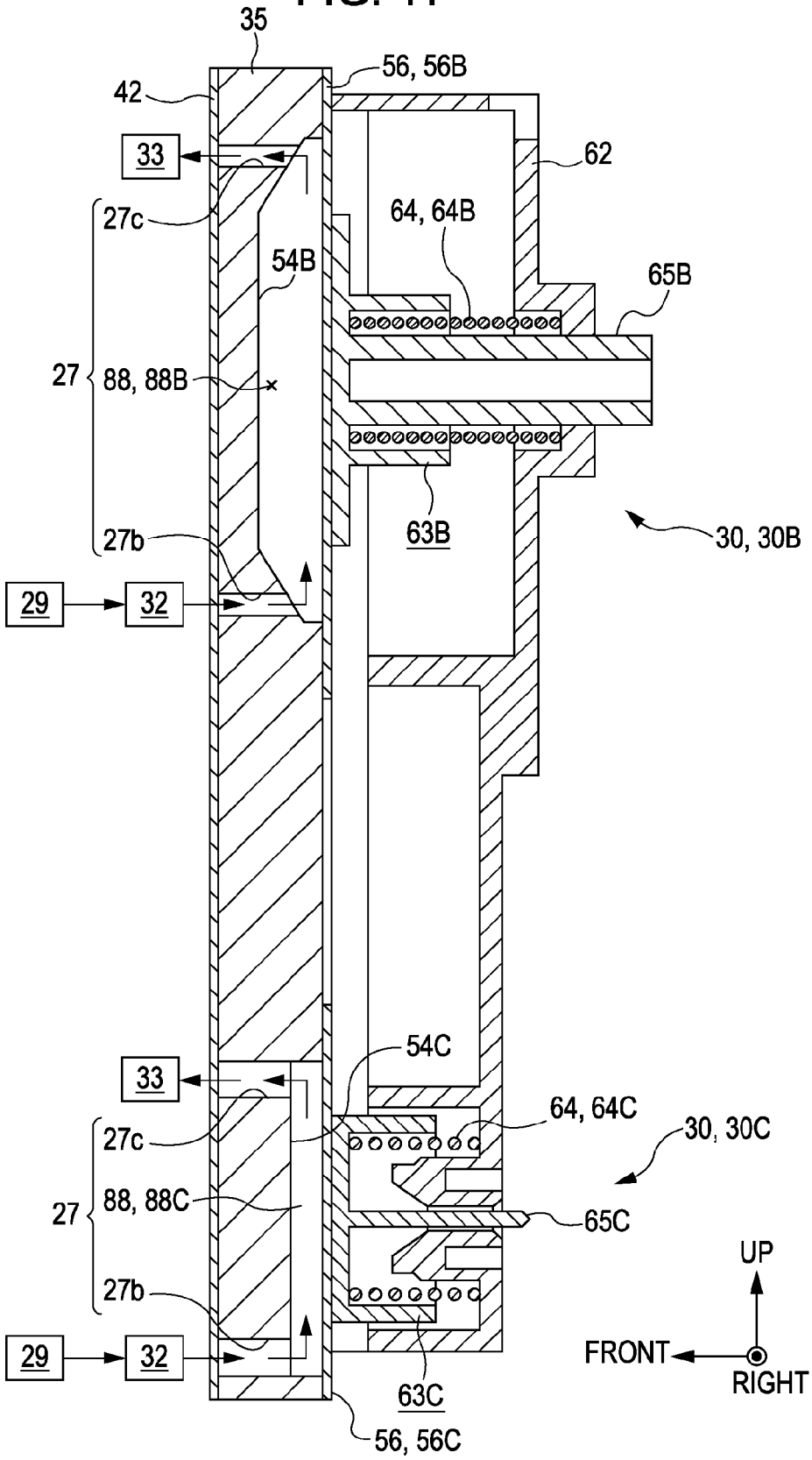
FIG. 11 is a cross-sectional view for describing a configuration of a pump.

As shown in FIG. 11, the black buffer 30B includes a pressure receiving member 63B and a third coil spring 64B. Furthermore, the black buffer 30B includes a buffer chamber 88 (a black buffer chamber 88B) which is surrounded and formed by a buffer concave section 54B formed at the rear of the flow path forming member 35 and the fourth film member 56B. In addition, each buffer chamber 88 constitutes a part of the liquid supplying path 27.

The pressure receiving member 63B is fixed to the rear of the fourth film member 56B, and the third coil spring 64B is placed between the pressure receiving member 63B and the cover member 62. Moreover, the fourth film member 56B is biased in a direction (front in the present embodiment) of reducing the volume of the black buffer chamber 88B by the biasing force of the third coil spring 64B.

The color buffer 30C includes a pressure receiving member 63C and a third coil spring 64C. Furthermore, the color buffer 30C includes a buffer chamber 88 (a color buffer chamber 88C) which is surrounded and formed by a buffer concave section 54C formed at the rear of the flow path forming member 35 and the fourth film member 56C.

The pressure receiving member 63C is placed at the rear side of the fourth film member 56C, and the third coil spring 64C is placed between the pressure receiving member 63C and the cover member 62. Moreover, the fourth film member 56C is biased in a direction (front in the present embodiment) of reducing the volume of the color buffer chamber 88C by the biasing force of the third coil spring 64C.

When the pump 29 performs the discharging operation, the pressed ink flows in each buffer chamber 88 through the second flow path 27*b*. Moreover, the biasing force of each third coil spring 64 is set to be smaller than the pressing force of ink flowing along with the discharging operation of the pump 29. For that reason, when the pump 29 performs the discharging operation, the fourth film member 56 is displaced in a direction (rear in the present embodiment) of expanding of the volume of the buffer chamber 88 against the biasing force of the third coil spring 64 by the pressing force of ink, and ink is supplied toward the choke valve 33 side through the third flow path 27*c* under pressure. In addition, the pressure receiving member 63, the third coil spring 64, and the fourth film member 56 function as movable sections for providing ink temporarily stored in the buffer chamber 88 under pressure. Furthermore, the fourth film member 56 functions as a movable wall for changing the volume of the buffer chamber 88.

Meanwhile, when the pump 29 performs the suction operation, the discharging side one-way valve 32 is closed and the supplying of ink from the pump 29 side is stopped. In the meantime, the fourth film member 56 is displaced in a direction (front in the present embodiment) of reducing the volume of the buffer chamber 88 against the biasing force of the third coil spring 64, and supplies ink toward the choke valve 33 side through the third flow path 27*c* under pressure.

Next, a configuration and an operation of the choke valve 33 will be described.

Figure 12B:
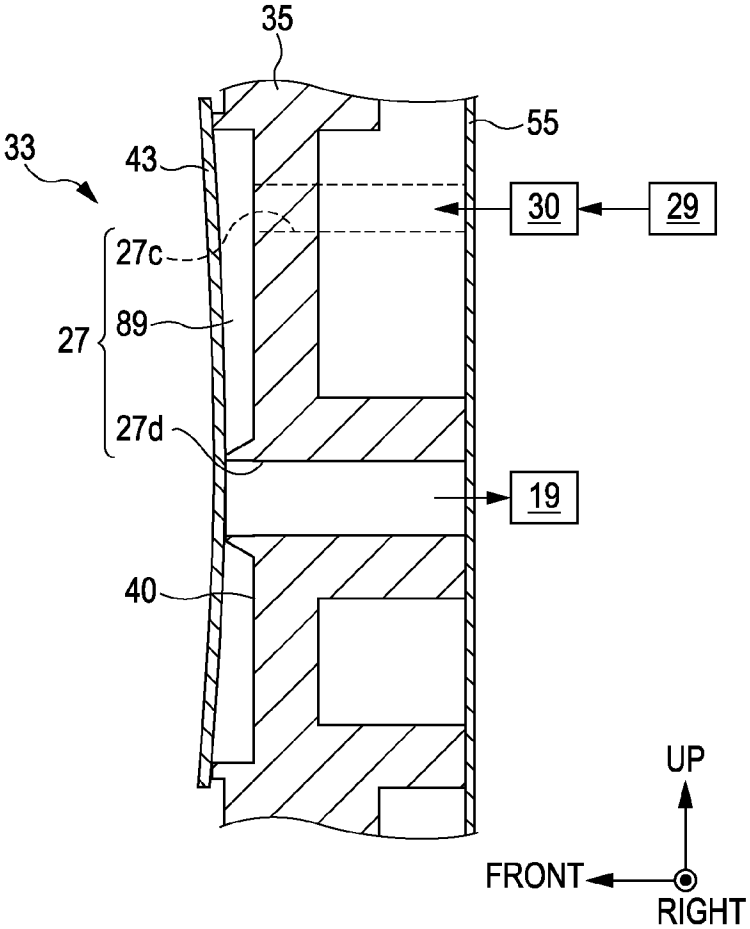
FIG. 12B is a cross-sectional view of the choke valve when the valve is closed.
Figure 12A:
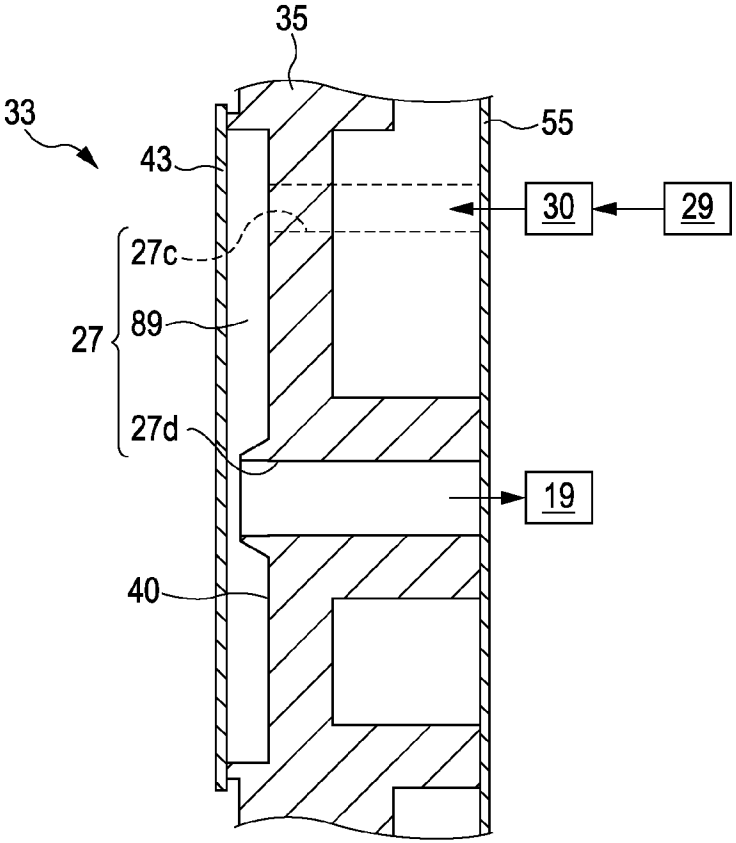
FIG. 12A is a cross-sectional view that shows a choke valve when the valve is opened.

As shown in FIG. 12A, the choke valve 33 includes a differential pressure valve chamber 89 which is surrounded and formed by a choke valve concave section 40 formed in front of the flow path forming member 35 and the second film member 43. In addition, the differential pressure valve chamber 89 constitutes a part of the liquid supplying path 27.

When the pump 29 is driven, ink is consecutively supplied to the differential pressure valve chamber 89 through the third flow path 27*c* under pressure. Specifically, when the pump 29 performs the discharging operation, ink is supplied by the discharging force of the pump 29, and when the pump 29 performs the suction operation, ink is supplied by the pressing force of the buffer 30. Moreover, when ink is supplied, the inner portion of the differential pressure valve chamber 89 receives a positive pressure. Thus, the second film member 43 is held in the state of being separated from the opening portion of the through hole 78, and ink is supplied toward the liquid ejecting head 19 side through the fourth flow path 27*d*.

Meanwhile, when executing the suction cleaning, as ink in the liquid ejecting head 19 is discharged, ink in the differential pressure valve chamber 89 flows out through the fourth flow path 27*d*, and the inner portion of the differential pressure valve chamber 89 receives the negative pressure. Then, as shown in FIG. 12B, the second film member 43 is displaced in a direction (rear in the present embodiment) of reducing the volume of the differential pressure valve chamber 89 and comes into contact with the opening portion of the through hole 78. That is, the choke valve 33 is closed to block the liquid supplying path 27. Furthermore, when the pump 29 performs the discharging operation in this state, ink is supplied into the differential pressure valve chamber 89, the negative pressure is cancelled, and the second film member 43 is separated from the opening portion of the through hole 78. That is, the choke valve 33 is opened to open the liquid supplying path 27.

Next, an operation of the liquid supplying apparatus 20 will be described.

The buffer chamber 88 constituting the buffer 30 has the third film member 55 constituting a part of the wall surface as a movable section so as to supply the temporarily stored ink toward the liquid ejecting head 19 side under pressure.

Moreover, the third film member 55 is welded to the flow path forming member 35 in the deflected state so as to ensure flexibility. For example, the third film member 55 is thermally welded to the outer edge portion of the buffer concave section 54 in the manner of pushing the third film member 55 into the buffer concave section 54 by a pressing member (not shown) along the shape of the buffer concave section 54.

For that reason, the movable portion of the third film member 55 subjected to a deflecting displacement enters a slightly stretched state by the pressing and becomes thinner than before the welding. Thus, it is not desirable to apply an excessive load. For that reason, in the printer 11 of the present embodiment, since the choke valve 33 is provided at the downstream side of the buffer chamber 88, when performing the choke cleaning, the choke valve 33 is closed, whereby the excessive negative pressure is not applied to the inner portion of the buffer chamber 88. Thus, it is suppressed that an excessive load is applied to the third film member 55 constituting the movable part of the buffer chamber 88.

Furthermore, in the liquid supplying apparatus 20, since the storage capacity of the black buffer chamber 88B is greater than that of the color buffer chamber 88C, even when the printer 11 is often used in the monochrome printing, more black ink can effectively be supplied. In addition, the black buffer chamber 88B is placed above the color buffer chamber 88C, whereby the black ink can be supplied from a high position. Thus, it is possible to increase the water head difference between the black buffer chamber 88B and the liquid ejecting head 19, thereby assisting the supplying of the black ink.

On the contrary, since the plurality of color buffer chambers 88C is placed so as to be aligned in the horizontal scanning direction X, compared to a case where the plurality of color buffer chambers 88C is placed so as to be aligned in the vertical direction Z, the heights of the liquid supplying apparatus 20 and the printer 11 are reduced.

In addition, the pump 29, the suction side one-way valve 31, the discharging side one-way valve 32, and the choke valve 33 are placed in the first region 34L of the flow path forming member 35. Meanwhile, each buffer chamber 88 is placed in the second region 34R which is placed so as to be aligned with the first region 34L in the horizontal scanning direction X. For that reason, it is possible to increase the storage capacity of the black buffer chamber 88B compared to the related art, without increasing the heights of the liquid supplying apparatus 20 and the printer 11.

In addition, in the flow path forming member 35 forming a plate shape, since the pump concave section 39 and the discharging side concave section 50 are provided so as to overlap with each other in the vertical direction Z, the heights of the liquid supplying apparatus 20 and the printer 11 are reduced by the overlapped height. In addition, in the flow path forming member 35, the liquid supplying path 27 is constituted by the through hole 68 which is provided in the flow path forming member 35 so as to communicate with the pump concave section 39 and the discharging side concave section 50. Thus, it is possible to shorten the length of the liquid supplying path 27 between the pump 29 and the discharging side one-way valve 32 to the thickness of the flow path forming member 35.

On the contrary, since the first flow path 27*a*, which is the liquid supplying path 27 between the suction side one-way valve 31 and the pump 29, is formed by the groove-shaped first flow path forming concave section 51, the length of the first flow path 27*a* is longer than the length of the liquid supplying path 27 between the pump 29 and the discharging side one-way valve 32. For that reason, the flow path resistance between the suction side one-way valve 31 and the pump 29 becomes greater than that between the pump 29 and the discharging side one-way valve 32, and the back flow from the pump 29 to the ink cartridge 15 side is suppressed.

Furthermore, the suction side valve main body 59 of the suction side one-way valve 31 is biased in a direction of being closed by the second coil spring 60. Meanwhile, the discharging side valve main body 57 of the discharging side one-way valve 32 is not biased by the biasing member but is displaced only by the pressure of ink. Thus, it is possible to suppress the back flow of ink from the pump 29 to the ink cartridge 15 side in the suction side one-way valve 31, and it is possible to effectively supply ink to the downstream side in the discharging side one-way valve 32.

In addition, the opening area of the suction side concave section 52 is formed to be greater than that of the discharging side concave section 50. As a consequence, the pressure receiving area in the liquid supplying path 27 of the suction side valve main body 59 covering the suction side concave section 52 is greater than that in the liquid supplying path 27 of the discharging side valve main body 57 covering the discharging side concave section 50. Thus, in the suction side one-way valve 31, the suction side valve main body 59 is able to open the liquid supplying path 27 against the biasing force of the second coil spring 60.

According to the embodiment mentioned above, the following effects can be obtained:

(1) The buffer chamber 88 is placed so as to be aligned with the pump 29 in the horizontal scanning direction X intersecting the vertical direction Z, and thus, as compared to a case where the pump 29 and the buffer chamber 88 are placed so as to be aligned in the vertical direction Z, the height of the apparatus can be reduced.

(2) Since the storage capacity of the black buffer chamber 88B is greater than that of the color buffer chamber 88C, it is possible to increase the maximum supplying amount of the black ink per unit of time. As a result, even when the consumption of the black ink per unit of time is increased, such as the case of performing the monochrome printing, the supplying insufficiency of the black ink can be suppressed.

(3) The cartridge holder 14 and each buffer chamber 88 are placed above the movement region of the carriage 17, it is possible to assist the supplying of ink to the liquid ejecting head 19 by the water head difference between each buffer chamber 88 and the liquid ejecting head 19. In addition, the black buffer chamber 88B is placed above the color buffer chamber 88C, and thus, the water head difference between the black buffer chamber 88B and the liquid ejecting head 19 compared to the case of the color buffer chamber 88C. As a result, even when the consumption of the black ink per unit of time is increased, such as the case of performing the monochrome printing, the black ink can effectively be supplied by the great water head difference.

(4) Since the plurality of color buffer chambers 88C is placed so as to be aligned in the horizontal scanning direction X, compared to a case where the plurality of color buffer chambers 88C is placed so as to be aligned in the vertical direction Z, the height of the apparatus can be reduced.

(5) Since the choke valve 33 is provided between the buffer chamber 88 and the liquid ejecting head 19, that is, at the downstream side of the buffer chamber 88, when performing the choke cleaning, the liquid supplying path 27 is blocked at the downstream side of the buffer chamber 88. Thus, it is possible to reduce the negative pressure reaching the buffer chamber 88 when performing the choke cleaning and suppress the load applied to the fourth film member 56.

(6) The discharging side valve main body 57 blocks and opens the liquid supplying path 27 by being displaced by the pressure difference between the upstream side and the downstream side, and thus, it is possible to effectively open the liquid supplying path 27 even by a minor pressure difference.

(7) Since the suction side one-way valve 31 has the second coil spring 60 that biases the suction side valve main body 59, compared to the case of not having the second coil spring 60, it is possible to more reliably suppress the flow of ink from the downstream side to the upstream side.

(8) In the liquid supplying path 27, since the pressure receiving area of the suction side valve main body 59 is greater than that of the discharging side valve main body 57, the suction side one-way valve 31 is able to open the liquid supplying path 27 against the biasing force of the second coil spring 60 when the pump 29 performs the suction operation.

(9) The length of the liquid supplying path 27 between the suction side one-way valve 31 and pump 29 is longer than that of the liquid supplying path 27 between the pump 29 and the discharging side one-way valve 32. Thus, the flow path resistance between the suction side one-way valve 31 and the pump 29 becomes greater than that between the pump 29 and the discharging side one-way valve 32. As a result, it is possible to more reliably suppress the flow of ink from the pump 29 toward the ink cartridge 15 side.

(10) The pump concave section 39 and the discharging side concave section 50 of the discharging side one-way valve 32 are placed in the flow path forming member 35 so as to overlap with each other in the vertical direction Z. Thus, the height of the liquid supplying apparatus 20 can be reduced. Furthermore, by using the through hole 68 communicating with the pump concave section 39 and the discharging side concave section 50 as the liquid supplying path 27, it is possible to shorten the length of the liquid supplying path 27 between the pump 29 and the discharging side one-way valve 32, thereby reducing the flow path resistance.

Figure 13:
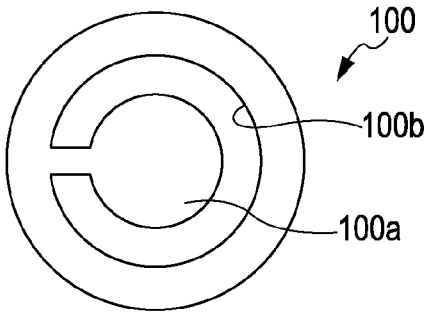
FIG. 13 is a front view that shows a modified example of a discharging side valve main body.
Figure 14:
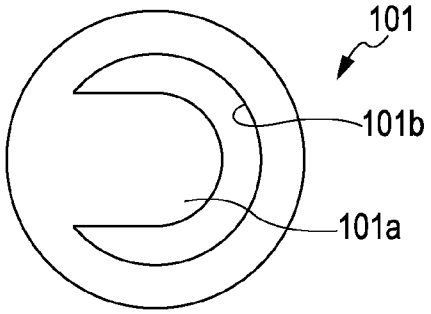
FIG. 14 is a front view that shows a modified example of a discharging side valve main body.
Figure 15:
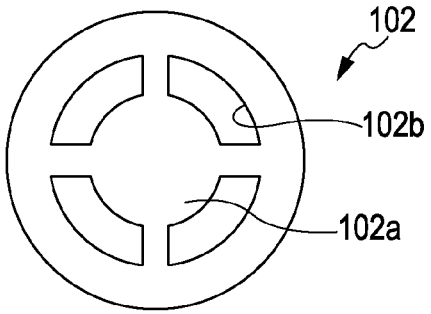
FIG. 15 is a front view that shows a modified example of a discharging side valve main body.
Figure 16:
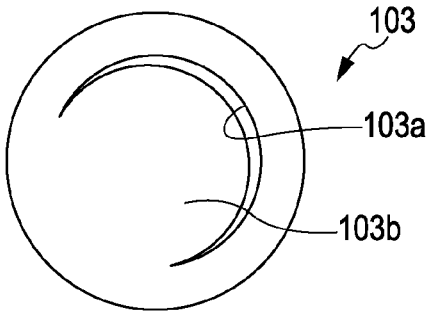
FIG. 16 is a front view that shows a modified example of a discharging side valve main body.
Figure 17:
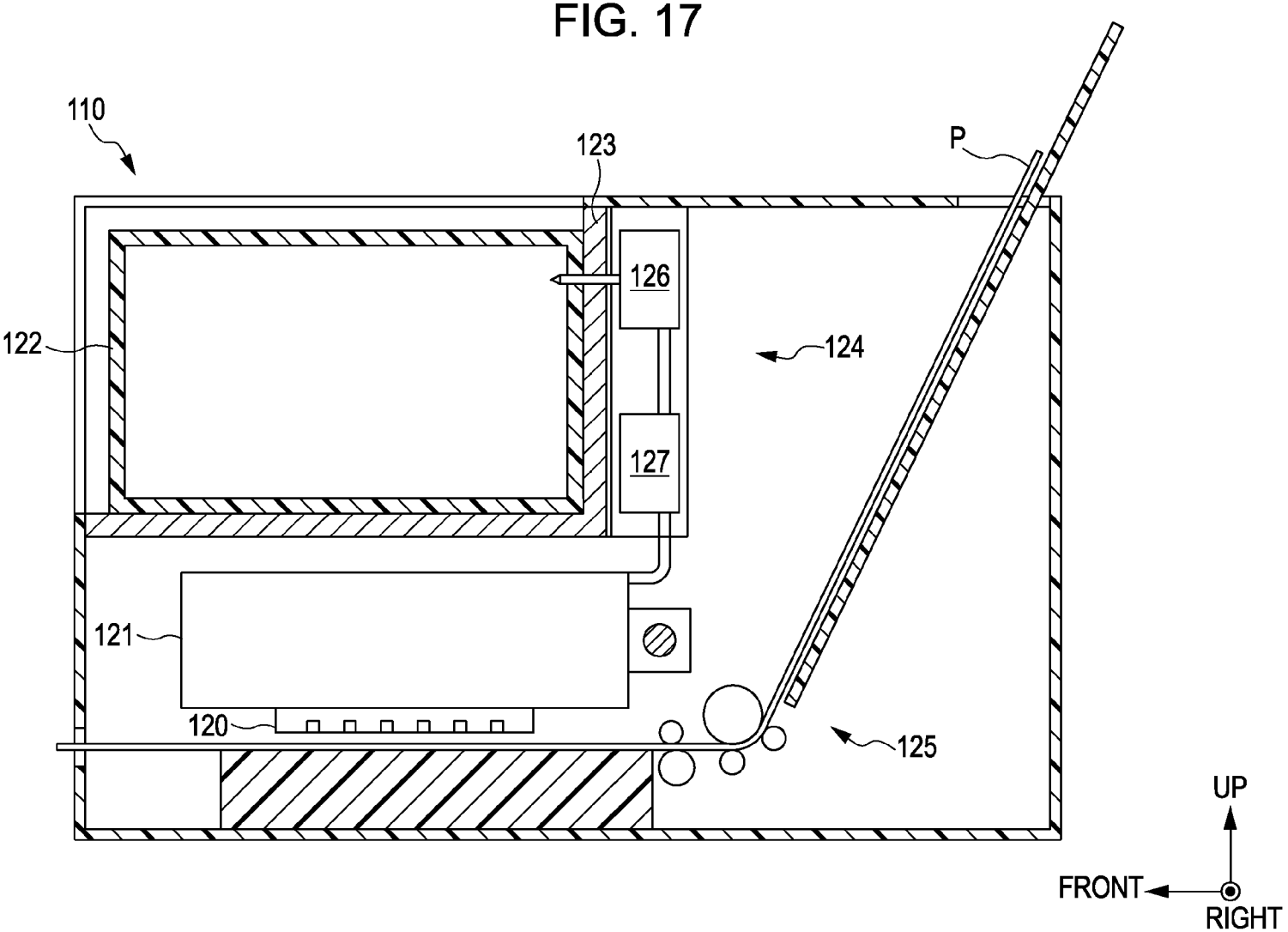
FIG. 17 is a cross-sectional view in which a liquid ejecting apparatus of the related art is viewed from a side.
Figure 18:
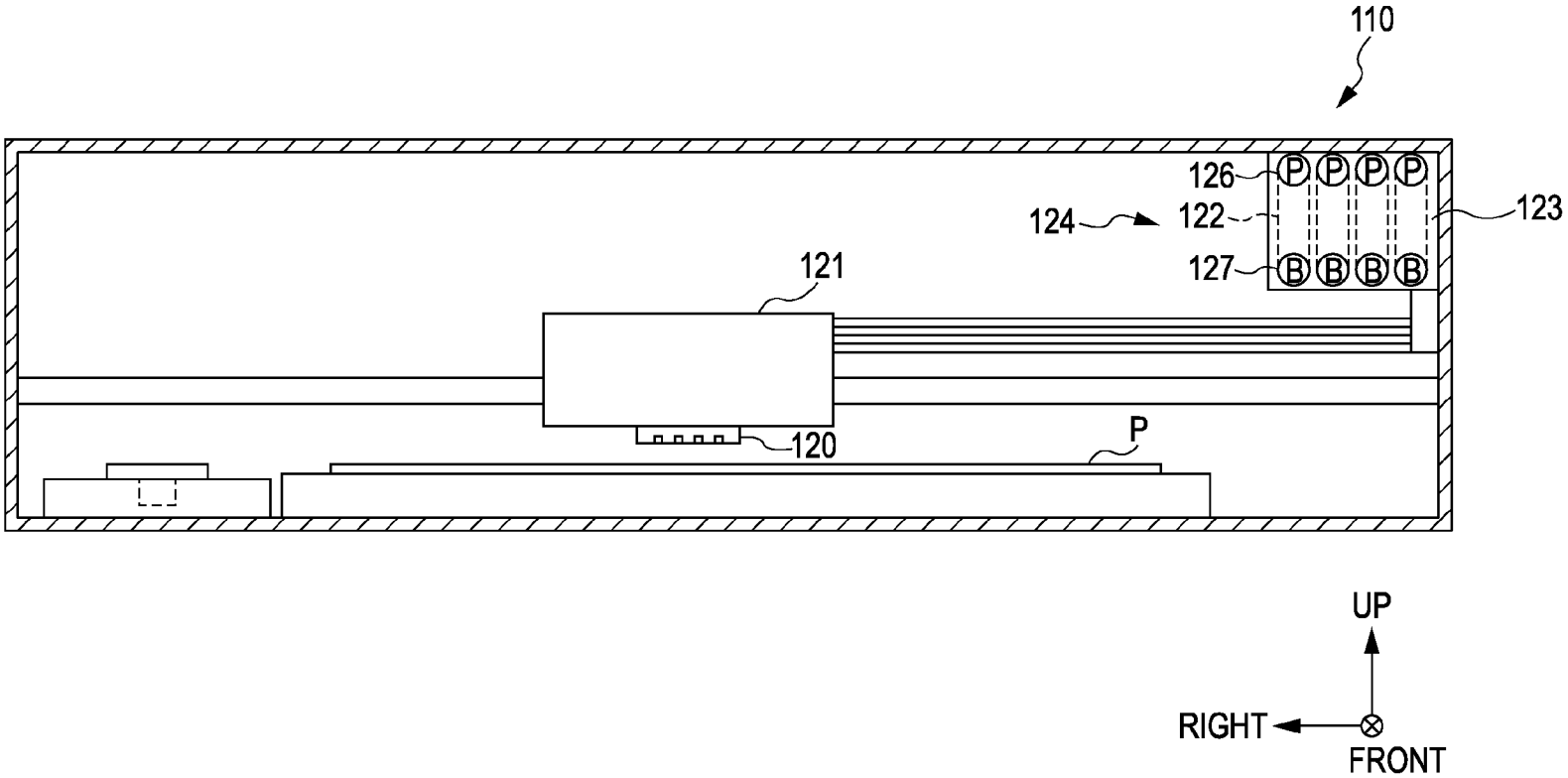
FIG. 18 is a cross-sectional view in which a liquid ejecting apparatus of the related art is viewed from a rear.

In addition, the embodiment may be modified as follow:

The discharging side valve main body of the discharging side one-way valve 32 may be modified like FIGS. 13 to 16. Specifically, as shown in FIG. 13, the discharging side valve main body 100 may have a contact section 100*a* of an approximately circular shape when viewed from front, and one communication hole 100*b* of an arc shape when viewed from front. Otherwise, as shown in FIG. 14, the discharging side valve main body 101 may have a contact section 101*a* which is extended from the outer edge side toward the center at an approximately equal width and in which a tip side thereof forms a semi-circular shape when viewed from the plane, and one communication hole 101*b* of an approximately arc shape when viewed from front. Otherwise, as shown in FIG. 15, the discharging side valve main body 102 may have a contact section 102*a* of an approximately circular shape when viewed from front, and four communication holes 102*b* of an approximately arc shape when viewed from front. In addition, in the same drawing, the number of the communication holes placed so as to surround the contact section of approximately circular shape when viewed from front can be arbitrarily changed to three, five or more or the like. Otherwise, as shown in FIG. 16, the discharging side valve main body 103 may have the contact section 103*b* which can be displaced by one cutting 103*a* of an arc shape when viewed from front.

In the second region 34R, the dimension and the placement of the buffer 30 corresponding to each color may be changed. For example, when liquid of a specific color and type is often used, the volume of the buffer chamber 88 can be changed so that the storage capacity of the liquid is increased. Furthermore, the number of the buffer 30 may be arbitrarily changed depending on the color of ink to be used and the kind of liquid, and a plurality of buffers 30 may correspond to liquid of one color and kind.

The second region 34R may be placed at the left side of the first region 34L.

The liquid supplying apparatus 20 and the maintenance device 23 may be placed at the same end portion side in the longer direction of the frame 12.

The length of the liquid supplying path 27 between the suction side one-way valve 31 and pump 29, and the length of the liquid supplying path 27 between pump 29 and the discharging side one-way valve 32 may be arbitrarily changed. Furthermore, in the first region 34L, the placement and the dimension of the pump 29, the suction side one-way valve 31, the discharging side one-way valve 32, and the choke valve 33 may be changed.

The choke valve 33 may be an on-off valve such as an electromagnetic valve capable of performing an on-off operation at an arbitrary timing, without being limited to the differential pressure valve which is opened and closed depending on the pressure difference between the upstream side and the downstream side.

The movable wall of the buffer 30 may be constituted by a member such as a piston, without being limited to the film member.

The printer may be an on-carriage type in which the ink cartridge 15 is mounted on the carriage 17. Otherwise, the printer may be a line head type printer or a lateral type printer which is able to perform the printing of a paper maximum width range even while fixing the liquid ejecting head 19, without being limited to a serial type printer in which the carriage 17 is moved in the horizontal scanning direction X. In addition, the printer may be an ink jet type label printer, a bar code printer, a ticketing device or the like.

The liquid ejecting apparatus may be a FAX device, a copying device, and a multifunction machine having multiple functions or the like without being limited to the printer. In addition, a liquid ejecting apparatus may be adopted which ejects or discharges liquid other than ink, and the liquid ejecting apparatus is able to be diverted to various liquid ejecting apparatuses which include a liquid ejecting head or the like discharging a minute amount of liquid droplet. In addition, the liquid droplet refers to a liquid state discharged from the liquid ejecting apparatus, and also includes one leaving traces in a granular shape, a tear shape, and a filiform shape. Furthermore, liquid described herein may be a material capable of being ejected from the liquid ejecting apparatus. For example, the material may have a state when a substance is a liquid phase, and includes a liquid state having high or low viscosity, a flow regime like a liquid phase metal (a metallic melt), sol, gel water, other inorganic solvents, an organic solvent, a solution, and a liquid phase resin, liquid as one state of the substance, as well as material in which particles of a functional material formed of a solid body such as pigment and metallic particles are dissolved, dispersed or mixed in the solvent or the like. Furthermore, as a typical example of liquid, there are ink, the liquid crystal or the like described in the embodiment mentioned above. Herein, ink includes various liquid compositions such as a general water-based ink, an oil-based ink, a gel ink, and a hot-melt ink. As a specific example of the liquid ejecting apparatus, for example, a liquid ejecting apparatus may be adopted which ejects liquid including a material such as an electrode material and a color material used in manufacturing a liquid crystal display, an EL (electroluminescence) display, a surface emitting display, and a color filter in the form of dispersion or dissolution. Furthermore, the liquid ejecting apparatus may be a liquid ejecting apparatus which ejects a living body organic matter used in manufacturing a bio chip, a liquid ejecting apparatus which is used as a precision pipette and ejects liquid which becomes a sample, a printing device, a micro dispenser or the like. In addition, it may be possible to adopt a liquid ejecting apparatus which ejects lubricant oil by pinpoint to a precision machine such as a watch and a camera, a liquid ejecting apparatus which ejects transparent resin liquid such as an ultraviolet curing resin onto a substrate so as to form a micro hemispherical lens (an optical lens) or the like used in an optical communication element or the like, and a liquid ejecting apparatus which ejects etching liquid such as acid or alkali so as to etch a substrate or the like.

The entire disclosure of Japanese Patent Application No. 2011-029956, filed Feb. 15, 2011 and 2011-029957, filed Feb. 15, 2011 are expressly incorporated by reference herein.

What is claimed is:

1. A liquid supplying apparatus comprising:

a liquid supplying path for supplying liquid from an upstream side which becomes a liquid accommodator side accommodating the liquid toward a downstream side which becomes a liquid ejecting head side ejecting the liquid;

a pump which performs a suction operation of sucking the liquid accommodated in the liquid accommodator and a discharging operation of discharging the sucked liquid toward the liquid ejecting head side;

a buffer chamber which is provided at a downstream side of the pump in the liquid supplying path, temporarily stores the liquid discharged from the pump, and has a movable section for supplying the temporarily stored liquid toward the liquid ejecting head side under pressure;

a differential pressure valve which is provided between the buffer chamber and the liquid ejecting head in the liquid supplying path, and is closed to block the liquid supplying path when a negative pressure of the downstream side which becomes the liquid ejecting head side is greater than a pressing force of an upstream side which becomes a buffer chamber side; and a discharging side one-way valve which is provided between the pump and the buffer chamber in the liquid supplying path, is closed along with the suction operation of the pump, and is opened along with the discharging operation of the pump, wherein the pump is a diaphragm type pump which has a pump concave section provided on a first surface of a flow path forming member forming a plate shape, and a diaphragm which is formed so as to surround the pump chamber by covering an opening portion of the pump concave section, the discharging side one-way valve has a discharging side valve chamber that is formed so as to be surrounded and formed by a discharging side concave section provided on a second surface of an opposite side of the first surface of the flow path forming member and a flexible member attached to the flow path forming member so as to cover the opening portion of the discharging side concave section, and the pump concave section and the discharging side concave section are provided so as to overlap with each other in a vertical direction, and the liquid supplying path is constituted by a through hole provided in the flow path forming member so as to communicate with the pump concave section and the discharging side concave section.

2. The liquid supplying apparatus according to claim 1, further comprising:

a suction side one-way valve which is provided between the liquid accommodator and the pump in the liquid supplying path, is opened along with the suction operation of the pump, and is closed along with the discharging operation of the pump, wherein the discharging side one-way valve has a discharging side valve main body which closes and opens the liquid supplying path by being displaced depending on a pressure difference between a upstream side which becomes a pump side and a downstream side which becomes a buffer chamber side.

3. The liquid supplying apparatus according to claim 2, wherein a length of the liquid supplying path between the suction side one-way valve and the pump is longer than a length of the liquid supplying path between the pump and the discharging side one-way valve.

4. The liquid supplying apparatus according to claim 2, wherein the suction side one-way valve has a suction side valve main body which is able to block the liquid supplying path, and a biasing member which biases the suction side valve main body in a direction of blocking the liquid supplying path.

5. The liquid supplying apparatus according to claim 4, wherein a pressure receiving area in the liquid supplying path of the suction side valve main body is greater than that in the liquid supplying path of the discharging side valve main body.

6. A liquid ejecting apparatus comprising:

a liquid ejecting head that ejects liquid; and the liquid supplying apparatus according to claim 1.

7. A liquid ejecting apparatus comprising:

a liquid ejecting head that ejects liquid; and the liquid supplying apparatus according to claim 2.

8. A liquid ejecting apparatus comprising:

a liquid ejecting head that ejects liquid; and the liquid supplying apparatus according to claim 4.

9. A liquid ejecting apparatus comprising:

a liquid ejecting head that ejects liquid; and the liquid supplying apparatus according to claim 5.

10. A liquid ejecting apparatus comprising:

a liquid ejecting head that ejects liquid; and the liquid supplying apparatus according to claim 3.

11. A liquid supplying apparatus comprising:

a liquid accommodator holder which supports a liquid ejecting head ejecting liquid so as to mount a liquid accommodator accommodating the liquid, and is placed in a position corresponding to a movement region of a carriage reciprocating along a horizontal scanning direction intersecting a vertical direction;

a pump which is placed so as to be aligned with the liquid accommodator holder in a depth direction of the apparatus intersecting the horizontal scanning direction and the vertical direction, and performs a suction operation of sucking the liquid accommodated in the liquid accommodator and a discharging operation of discharging the sucked liquid toward the liquid ejecting head side; and a buffer chamber which is placed so as to be aligned with the liquid accommodator holder in the horizontal scanning direction, and temporarily stores the liquid discharged from the pump.

12. The liquid supplying apparatus according to claim 11, wherein the liquid accommodator holder is a cartridge holder to which a black ink cartridge accommodating black ink and a color ink cartridge accommodating color ink are mounted in an attachable and detachable manner, and a plurality of pumps and a plurality of buffer chambers are provided so as to correspond to each color ink, and a black buffer chamber, which is the buffer chamber for storing the black ink, has a storage capacity greater than that of a color buffer chamber which is the buffer chamber for storing the color ink.

13. The liquid supplying apparatus according to claim 12, wherein the cartridge holder and the respective buffer chambers are placed above the movement region, and the black buffer chamber is placed above the color buffer chamber.

14. The liquid supplying apparatus according to claim 12, wherein the cartridge holder is mounted with a plurality of color ink cartridges accommodating the color inks of different colors, and a plurality of color buffer chambers is provided corresponding to the respective color inks and is placed so as to be aligned with each other in the horizontal scanning direction.

15. A liquid ejecting apparatus comprising:

a liquid ejecting head that ejects liquid, a carriage that supports the liquid ejecting head and reciprocates along a horizontal scanning direction, and the liquid supplying apparatus according to claim 11.

16. A liquid ejecting apparatus comprising:

a liquid ejecting head that ejects liquid, a carriage that supports the liquid ejecting head and reciprocates along a horizontal scanning direction, and the liquid supplying apparatus according to claim 12.

17. A liquid ejecting apparatus comprising:

a liquid ejecting head that ejects liquid, a carriage that supports the liquid ejecting head and reciprocates along a horizontal scanning direction, and the liquid supplying apparatus according to claim 13.

18. A liquid ejecting apparatus comprising:

a liquid ejecting head that ejects liquid, a carriage that supports the liquid ejecting head and reciprocates along a horizontal scanning direction, and the liquid supplying apparatus according to claim 14.

* * * * *